US005794277A

United States Patent [19]

Jones

[11] Patent Number: 5,794,277

[45] Date of Patent: Aug. 18, 1998

[54] AUTOMATIC TOILET SEAT CLOSING DEVICE

[76] Inventor: Clifford D. Jones, 9424 Tulley Ave., Oak Lawn, Ill. 60453-2441

[21] Appl. No.: 818,094

[22] Filed: Mar. 14, 1997

[51] Int. Cl.[6] ..... A47K 13/12

[52] U.S. Cl. ..... 4/236; 4/240; 4/246.1

[58] Field of Search ..... 4/236, 240, 246.1, 4/248

[56] References Cited

U.S. PATENT DOCUMENTS

| | | | |
|---|---|---|---|
| 2,431,263 | 11/1947 | Lundgren | 4/236 |
| 2,692,394 | 10/1954 | Paulus | 4/234 |
| 4,395,784 | 8/1983 | Foster | 4/236 |
| 4,551,866 | 11/1985 | Hibbs | 4/246.1 |
| 4,561,130 | 12/1985 | Baumgardner et al. | 4/253 |
| 4,658,447 | 4/1987 | Smith | 4/236 |
| 4,724,551 | 2/1988 | Gardner | 4/253 |
| 4,853,983 | 8/1989 | Grant | 4/246.2 |
| 4,887,322 | 12/1989 | Lyndon | 4/248 X |
| 4,951,325 | 8/1990 | Tack | 4/246.1 |
| 4,982,453 | 1/1991 | Matsumoto | 4/248 |
| 4,995,120 | 2/1991 | Tager | 4/236 X |
| 5,060,318 | 10/1991 | Jaskiewicz | 4/248 X |
| 5,101,518 | 4/1992 | Phillips | 4/246.2 |
| 5,153,946 | 10/1992 | Yoke et al. | 4/248 |
| 5,177,818 | 1/1993 | Tsai | 4/241 |
| 5,193,230 | 3/1993 | Guerty | 4/246.2 |
| 5,220,693 | 6/1993 | Paglia | 4/246.1 |
| 5,222,260 | 6/1993 | Piper | 4/246.1 |
| 5,267,356 | 12/1993 | Gideon et al. | 4/246.2 |
| 5,267,357 | 12/1993 | Ades | 4/253 |
| 5,276,945 | 1/1994 | Matsumura | 4/240 X |
| 5,279,000 | 1/1994 | Mercier et al. | 4/240 |
| 5,280,653 | 1/1994 | Tsai | 4/246.2 |
| 5,280,654 | 1/1994 | Wolfer | 4/246.1 |
| 5,289,593 | 3/1994 | Lawrence | 4/246.1 |
| 5,307,524 | 5/1994 | Veal | 4/246.1 |
| 5,323,496 | 6/1994 | Blair | 4/246.3 |

(List continued on next page.)

OTHER PUBLICATIONS

*Golf Illustrated*, Mar./Apr. 1997, p. 45, featuring an advertisement for the WatchDog Golf Club Security system.

*Primary Examiner*—Robert M. Fetsuga
*Attorney, Agent, or Firm*—Kathleen Anne Ryan

[57] ABSTRACT

A device automatically closes the cover of a container after a predetermined time interval and is used in combination with a timing member, such as a conventional mechanical timer, that includes timer mechanism for measuring a predetermined time interval, a shaft that is rotatable between a de-activated position and an activated position, and an arm that is moveable between an extended position and a retracted position. The device includes a plate member, a first hinge assembly, a first hinge member, a coupling mechanism, a gear, and a connection mechanism. The first hinge assembly includes a cylindrical member that is rotatable in a first direction and a second direction and has a chamber which is sized to receive a portion of the shaft. The hinge member is secured to the cylindrical member and rotates concurrently with the cylindrical member. The coupling mechanism couples the hinge assembly to the timing member such that rotation of the cylindrical member in the first direction rotates the shaft from the de-activated position to the activated position. The gear is rotatable between a rest position and an energized position. The connection mechanism connects the gear to a portion of the cylindrical member such that rotation of the cylindrical member in the first direction rotates the gear from the rest position to the energized position. The device also includes a retention coupling mechanism that couples the gear to the arm when the arm is in the retracted position and thereby retains the gear in the energized position, a reverse rotation mechanism that rotates the gear from the energized position to the rest position at the completion of the pre-determined time interval, and an attaching member that attaches the cover of the container to the first hinge member such that the cover moves to the closed position when the cylindrical member rotates in the second direction.

27 Claims, 21 Drawing Sheets

U.S. PATENT DOCUMENTS

| | | | |
|---|---|---|---|
| 5,327,589 | 7/1994 | Rice | 4/246.2 |
| 5,343,571 | 9/1994 | Guerty | 4/246.2 |
| 5,369,814 | 12/1994 | Denys | 4/246.2 |
| 5,371,906 | 12/1994 | Tzang | 4/246.1 |
| 5,388,281 | 2/1995 | Wiklund et al. | 4/248 |
| 5,400,442 | 3/1995 | Pendlebury | 4/246.2 |
| 5,414,875 | 5/1995 | Kappl et al. | 4/236 |
| 5,430,897 | 7/1995 | Lavender | 4/246.1 |
| 5,444,877 | 8/1995 | Kamarasuier | 4/246.1 |
| 5,461,734 | 10/1995 | Faircloth | 4/246.1 |
| 5,504,947 | 4/1996 | Robello et al. | 4/246.1 |
| 5,546,612 | 8/1996 | Johnson | 4/248 |
| 5,570,478 | 11/1996 | Armstrong | 4/246.1 |

AUTOMATIC TOILET SEAT CLOSING DEVICE

FIELD OF THE INVENTION

This invention relates generally to automatic closing devices and in particular to devices that automatically lower a toilet seat from a raised position after a pre-determined time period.

BACKGROUND OF THE INVENTION

Conventional toilets typically include a toilet bowl, a seat, and a lid. Such types of conventional toilets are frequently used by both men and women. When a man uses a conventional toilet to urinate, the seat and lid are typically raised to provide direct access to the toilet bowl. Women, on the other hand, usually prefer to use the toilet with the seat lowered, in a closed position. This difference in usage can lead to well-known problems because many men do not lower the toilet seat to the closed position after use. Several devices have been proposed to automatically move a toilet seat to the closed position. Existing devices can be categorized into three general classes. The first class includes devices which must be manually activated by a user. The second class includes devices which are activated when the toilet is flushed. The third class includes devices which automatically close the toilet seat after a time interval. Kamarasurier, U.S. Pat. No. 5,444,877 is an example of a device in the first class. The device in Kamarasurier includes a foot operated double acting lever for rotating the seat to the open position. A lock catch then holds the seat in the open position. When the foot pedal on the lever is depressed after the seat has been opened, the lock catch is withdrawn and a driver gear rotates the seat to the closed position.

The second class includes devices that close the toilet seat after the toilet has been flushed. This class can be further subdivided into five subdivisions depending on the method used for moving the seat to the closed position. The first subdivision includes devices in which the seat is biased towards the closed position. For example, Armstrong, U.S. Pat. No. 5,570,478 discloses a device which includes a spring-biased shaft that is coupled to the seat hinge. When the seat is raised, the seat is biased towards the closed position. The device also includes a lock that engages the shaft and retains the seat in the open position and a flush detector that senses when the toilet is flushed. When the sensor detects that the toilet is flushed, the lock releases the shaft which then moves the toilet seat to the closed position. Johnson, U.S. Pat. No. 5,546,612 is another example of devices in this subdivision. The second subdivision includes devices that push or pull the toilet seat closed when the toilet is flushed. For example, Lavender, U.S. Pat. No. 5,430,897 discloses a device which includes a trip wire that pushes the seat closed when the toilet is flushed. The trip wire is attached one end to the toilet flush crank arm and extends from the crank arm through a guide. The other end of the trip wire is positioned by the guide to be adjacent the seat when the seat is raised. When the crank arm is depressed to flush the toilet, the crank arm presses on the first end of the trip wire which then causes the second end of the trip wire to push the toilet seat towards the closed position. Other examples of devices in this subdivision include Lawrence, U.S. Pat. No. 5,289,593, Piper, U.S. Pat. No. 5,222,260, and Jaskiewicz, U.S. Pat. No. 5,060,318. The third subdivision includes devices that use a piston-like component to automatically close the toilet seat when the toilet is flushed. An example of such a device is Robello et al., U.S. Pat. No. 5,504,947 which discloses a piston-like control cylinder that is coupled to the toilet seat through a seat closure member. The control cylinder operates in conjunction with a needle valve that is actuated by the toilet tank float valve. Raising the toilet seat causes the seat closure member to extend the piston rod in the control cylinder and thereby draw air into the cylinder through a one-way valve. When the toilet is flushed, the float valve falls and thereby releases the needle valve's seal and permits air to be expelled from the control cylinder. As the air is expelled, the piston rod is lowered within the control cylinder, thereby also lowering the seat closure control and the toilet seat. Additional examples of devices in this subdivision include Denys, U.S. Pat. No. 5,369,814 and Rice, U.S. Pat. No. 5,327,589. Pendlebury, U.S. Pat. No. 5,400,442 discloses a flush-actuated hydraulic hinge and is an example of a device in the fourth subdivision. The hinge includes a hydraulic motor that is driven by ancillary water which is re-routed from the toilet tank. When the toilet is flushed, the ancillary water flows to the hydraulic motor which then operates to lower the toilet seat. Gideon et al., U.S. Pat. No. 5,267,356 is another example of a device in the fourth subdivision. The fifth subdivision includes devices that use an electric motor to lower the toilet seat when the toilet is flushed. Veal, U.S. Pat. No. 5,307,524 is an example of such a device.

The third general class of devices which lower a toilet seat to the closed position includes devices that operate automatically after a timed interval. As with the second class, the third class of devices can be further subdivided into five subdivisions depending on the method used for measuring the time interval. The first subdivision includes devices which rely upon the physical properties of one component to delay the closing of the toilet seat after the seat has been raised. For example, Tack, U.S. Pat. No. 4,951,325 discloses a leaf spring which pushes the seat towards the closed position. The leaf spring extends from a base plate that is affixed to the front of the toilet tank so that the plate and spring are behind the raised toilet seat. The device also includes a suction cup that is secured to the base plate between the base plate and the leaf spring. When the seat is raised, the seat depresses the spring against the suction cup. When the suction cup releases the spring, the spring then pushes the toilet seat towards the closed position. The closing of the seat is thus delayed by the time required for the suction cup to release the leaf spring. The second subdivision includes devices which use an electronic timer to measure the time interval. For example, Tager, U.S. Pat. No. 4,995,120 discloses a device which includes a DC electric motor that is connected to the toilet seat through a reversible ratchet mechanism that has a pivot rod on which the seat pivots. The DC electric motor is also connected to an electronic time delay device. Raising the toilet seat to the open position activates the electronic time delay device which then measures the time interval. The DC electric motor is then energized at the completion of the time interval and moves the toilet seat to the closed position. The third subdivision includes devices which use a piston-like component to both measure the time interval and to move the toilet seat to the closed position. For example, Hibbs, U.S. Pat. No. 4,551,866 discloses a fluid-filled cylinder which includes a biasing spring that is coupled to a piston. The piston is also coupled to the toilet seat through a link arm. Raising the toilet seat raises the piston and compresses the biasing spring. Once the seat is raised the biasing spring tends to bias the piston to a lower position and the seat to the closed position. The movement of the piston and hence of the seat is retarded by the fluid within the cylinder. The forth subdivision includes devices that change the center of gravity of the seat to move the seat to the closed position. For example, Faircloth, U.S. Pat. No. 5,461,734 discloses a device that includes a chamber that is associated with the toilet seat and contains a moveable mass, such as a liquid, fine sand, or metal balls, which moves in response to the force of gravity and thus changes the center of gravity of the toilet seat. When the seat is in the closed position, the moveable mass tends to collect in a pre-determined portion of the chamber. When the toilet seat is raised, gravity moves the moveable mass to a second portion of the chamber which is lower than the first portion. The movement of the mass to the lower, second portion of the chamber effectively changes the center of gravity of the seat which then closes under the force of gravity. The time interval required for the seat to be lowered is determined by the shape of the chamber and the flow rate of the moveable mass. Phillips, U.S. Pat. No. 5,101,518 is another example of a device in this subdivision. The fifth subdivision includes devices that use a hydraulic timer mechanism in conjunction with a control mechanism to lower the toilet seat to the closed position after a time interval. For example, Yoke et al., U.S. Pat. No. 5,153,946 discloses a device which includes a control mechanism that has a spring that tends to bias the seat toward the closed position. The control device also includes various ratchet cams which prevent the spring from acting and thus lock the seat in the open position. The spring is operatively connected to a hydraulic timing mechanism that measures a time interval based on the flow rate of the fluid within the timing mechanism. Raising the seat energizes the spring and activates the hydraulic timing mechanism. Once raised, the seat is biased towards the closed position but is held upright by the locking cams. At the completion of the time interval, the locking cams release the spring and the seat then moves to the closed position. Other examples of devices in this subdivision include Wiklund et al., U.S. Pat. No. 5,388,281, Guerty, U.S. Pat. No. 5,343,571, Mercier et al., U.S. Pat. No. 5,279,000, and Guerty, U.S. Pat. No. 5,193,230.

Although the foregoing devices appear to solve the problem of automatically closing the toilet seat, the devices nonetheless suffer from various disadvantages. For example, in Kamarasurier the user must depress the pedal to move the toilet seat to the closed position. It seems reasonable to assume that men who cannot remember to close the toilet seat themselves may have an equally difficult time remembering to depress the pedal. All of the devices in the second class operate only when the toilet is flushed. However, it is an unfortunate fact that, in addition to forgetting to close the toilet seat after use, some men forget to flush the toilet. Some of the devices require extensive modification of the toilet seat and so are cumbersome, if not expensive, to implement. Some of the devices are large and unwieldy and generally detract from the appearance of the toilet. Some of the devices do not control the movement of the seat to the closed position and consequently may produce excessive wear and noise. Moreover, many of the devices do not operate on the toilet lid in addition to the toilet seat and so do not move both the seat and the lid to the closed position.

In addition to potentially inconveniencing subsequent users, an open toilet seat, as well as an open toilet lid, can lead to problems when young children or pets are present. Young children sometimes throw objects into the toilet bowl and the objects can become lost or cause the toilet to back up. In addition, young children are often are tempted to play in the water contained in the toilet bowl. Simple contact with the water can cause problems when chemical agents are used to disinfect and clean the toilet bowl. The chemically-treated water can also be a problem if a pet drinks the water contained in the toilet bowl. Several devices have been proposed to lock the toilet seat and lid in the closed position to prevent access to the toilet bowl. Smith, U.S. Pat. No. 4,658,447 discloses a locking device that replaces the conventional hinges used to pivotally connect the seat and the lid to the toilet bowl. The device includes a hollow rod on which replacement seat hinges, lid hinges, and mounting hinges are rotatably mounted. A plunger and a locking shaft are secured to a first end cap which closes one end of the hollow tube. The plunger extends from the end cap into the hollow rod and is secured by a spring to a second end cap which closes the other end of the hollow tube. When the seat and lid are in the closed position, the locking shaft extends through passages which are formed in the replacement seat hinges, lid hinges, and mounting hinges. The spring retains the locking shaft in the passages such that the locking shaft prevents the seat and lid from being rotated towards the open position. To unlock the device so that the seat and lid can be opened, the first end cap must be pulled out against the force of the spring to remove the locking shaft from the passages. Bumgardner et al., U.S. Pat. No. 4,561,130 disclose a device which is used in conjunction with the conventional hinges that pivotally connect the toilet seat and lid to the toilet bowl. The device includes a lid engaging bracket that grips the toilet lid. The bracket is also secured to a toggle link assembly which is in turn secured to the toilet rim. A bolt is used to adjust the toggle links so that the toggle links resist rotation of the lid and seat to the open position. Foster, U.S. Pat. No. 4,395,784 discloses a device which is used in conjunction with conventional seat and lid hinges. The device includes an interface hinge which engages the toilet seat and is secured to the toilet rim. A spring latch is biased against the interface hinge so that the spring latch acts as a rotational detente and prevents the interface hinge, and hence the lid, from being rotated to the open position. Ades, U.S. Pat. No. 5,267,357, Gardner, U.S. Pat. No. 4,724,551, Paulus, U.S. Pat. No. 2,692,394, and Lundgren, U.S. Pat. No. 2,431,263 also disclose devices which use rotational detents to block the movement of the lid to the open position. Although these devices lock the toilet seat and lid in the closed position, these devices suffer from drawbacks. Some of these devices must be attached to the toilet separately from the seat and lid hinges and so require some modification of the toilet. Some of these devices are unwieldy and detract from the appearance of the toilet. Moreover, none of these devices couple the lid hinge to the seat hinge so that the toilet lid closes simultaneously with the toilet seat and can be locked in the closed position.

It is therefore an object of the invention to provide a device that automatically moves a toilet seat to the closed position after a pre-determined time interval.

Another object of the invention is to provide an automatic toilet seat closing device that does not require extensive modification of an existing toilet.

Another object of the invention is to provide an automatic toilet seat closing device that is compact and unobtrusive and so does not detract from the appearance of the toilet.

Another object of the invention is to provide an automatic toilet seat closing device that moves the toilet seat to the closed position in a controlled manner.

Another object of the invention is to provide an automatic toilet seat closing device that couples the lid hinge to the seat hinge so that the movement of both the seat and the lid can be controlled by the device.

Another object of the invention is to provide an automatic toilet seat closing device that operates on the lid as well as on the seat so that both the lid and the seat are moved to the closed position after a pre-determined time interval.

Another object of the invention is to provide an automatic toilet seat closing device that includes a mechanism for locking the seat and the lid in the closed position. It is a further object of this invention to provide a replacement toilet seat and lid hinge assembly that can be used with a conventional toilet and that couples either the seat hinge or the lid hinge to a common pivot rod so that the movement of both the seat hinge and the lid hinge can be readily controlled.

Another object of the invention is to provide a replacement toilet seat and lid hinge assembly that can be used with a conventional toilet and that includes a mechanism for locking the seat and the lid in the closed position.

Another object of the invention is to provide a replacement toilet seat and lid hinge assembly that can be used with a conventional toilet and that includes a mechanism for coupling the lid hinge to the seat hinge so that the lid closes simultaneously with the seat.

SUMMARY OF THE INVENTION

These and other objectives and advantages are provided by the present invention which is directed to a device for automatically closing the cover of a container after a pre-determined time interval. The device is used with a container that includes a cover which is hingedly mounted on a body. The cover is moveable between a closed position in which the cover is substantially flush with the body and an open position in which the cover is pivotally raised above the body. An example of such a container is a conventional toilet which has a toilet seat that is hingedly mounted on a toilet bowl. The device is used in combination with a timing member, such as a conventional mechanical timer. An appropriate timing member for use with the device includes a timer mechanism for measuring a predetermined time interval, a shaft that is rotatable between a de-activated position and an activated position, and an arm that is moveable between an extended position and a retracted position. The shaft is operatively connected to the timer mechanism so that rotation of the shaft to the activated position activates the timer mechanism and so that the shaft automatically rotates to the de-activated position during the pre-determined time interval. The arm is also operatively connected to the timer mechanism so that the activation of the timer mechanism by the shaft moves the arm to the retracted position and so that the arm moves to the extended position at the completion of the pre-determined time interval.

The device includes a plate member, a first hinge assembly, a first hinge member, coupling means, a gear, and connection means. The plate member has an opening and is aligned with and secured to the timing member so that the shaft extends from the timing member through the opening. The first hinge assembly includes a cylindrical member that is rotatable in a first direction and a second direction and has a chamber which is sized to receive a portion of the shaft, the portion of the shaft being positioned within the chamber. The hinge member is secured to the cylindrical member opposite the portion of the shaft and rotates concurrently with the cylindrical member. The coupling means couples the hinge assembly to the timing member such that rotation of the cylindrical member in the first direction rotates the shaft from the de-activated position to the activated position. The gear is rotatable between a rest position and an energized position and has a centrally-positioned channel that is sized to encircle a portion of the cylindrical member. The gear is positioned to encircle the portion of the cylindrical member. The connection means connect the gear to the portion of the cylindrical member such that rotation of the cylindrical member in the first direction rotates the gear from the rest position to the energized position.

The device also includes retention coupling means, reverse rotation means, and attaching means. The retention coupling means couples the gear to the arm when the arm is in the retracted position and thereby retains the gear in the energized position. The retention coupling means can consist of a notched rack which is secured to the arm of the timing member and which is shaped to engage a portion of the gear. The reverse rotation rotates the gear from the energized position to the rest position at the completion of the pre-determined time interval. The reverse rotation means can be a spring which is secured to the gear and which biases the gear toward the rest position. The attaching means attaches the cover of the container to the first hinge member such that moving the cover from the closed position to the open position rotates the cylindrical member in the first direction and thereby rotates the shaft to the activated position. In addition, the attaching means attaches the cover to the first hinge member such that the cover moves to the closed position when the cylindrical member rotates in the second direction.

Once attached to the container, moving the cover to the open position rotates both the first hinge member and the first hinge assembly in the first direction and, because of the coupling means, rotates the shaft of the timing member to the activated position. Concurrently, the gear is energized and so biases the cover toward the closed position. However, the retention coupling means retains the gear in the energized position throughout the pre-determined time interval. Consequently, the cover also remains in the open position throughout the pre-determined time interval. At the completion of the pre-determined time interval, the arm of the timing member moves to the extended position and thereby releases the gear from the retention coupling means. The reverse rotation means then rotates the gear to the rest position, thereby also moving the cover to the closed position. The device thus closes the cover automatically upon the completion of the pre-determined time interval. In contrast, many existing toilet seat closing devices depend on an uncertain event, such as flushing the toilet, to trigger the closing of the toilet seat. The device is also compact and so does not detract from the appearance of the toilet. Moreover, the device is readily attached to the toilet by conventional attachment members, such as bolts or adhesive, and so does nor require extensive modification of the toilet.

The device can further include a second hinge assembly that couples the toilet lid hinge to the first hinge member so that the movement of both the seat hinge and the lid hinge can be readily controlled. The second hinge assembly includes a pivot rod, an anchor member, and a second hinge member. The pivot rod is secured to the first hinge member and extends outwardly from the first hinge member opposite the cylindrical member. The pivot rod thus rotates in the first direction concurrently with the cylindrical member and rotates in the second direction concurrently with the cylindrical member. The anchor member has a body portion and a bore extending through the body portion. The bore is sized and shaped to accommodate the pivot rod which extends from the first hinge member through the bore. The second hinge member has a duct that is sized and shaped to receive a portion of the pivot rod, the portion of the pivot rod being positioned within the duct. The second hinge member is rotatably coupled to the pivot rod and is rotatable between a closed configuration and an open configuration. The second hinge assembly also includes securement means for securing the anchor member to the body of the container. Since the pivot rod rotates concurrently with the first hinge member, the second hinge member can be coupled to the pivot rod so that the second hinge member also rotates concurrently with the first hinge member and with the cylindrical member.

The second hinge assembly can further include coupling means for coupling the second hinge member to the cylindrical member so that the second hinge member rotates towards the closed configuration when the cylindrical member rotates in the second direction. Consequently, the device operates on two cover members, such as a toilet seat and a toilet lid, so that both cover members are moved to the closed position after the pre-determined time interval. The coupling means of the second hinge assembly can include an elongated track, a latch, biasing means, a latch guide, and a camming surface. The elongated track is formed in the pivot rod and has a first end and a second end. The second end is positioned at least partially along the portion of the pivot rod that is positioned within the duct of the second hinge member. The latch is slidably positioned within the elongated track and includes a first portion and a second portion. The first portion has an outer surface that is shaped to conform with the shape of the pivot rod. The second portion is attached to the first portion intermediate the first portion and the second end of the elongated track and extends outwardly from the elongated track. The biasing means biases the latch toward the first end of the track. The latch guide is formed in the second hinge member and is positioned to intersect the duct and shaped to accommodate the second portion of the latch. The camming surface is formed within the bore of the anchor member and is positioned and shaped to engage the second portion of the latch. The camming surface urges the second portion of the latch into the latch guide when the cylindrical member rotates in the first direction and thereby couples the second hinge member to the cylindrical member. The biasing means urges the latch towards the first end of the elongated track when the cylindrical member rotates in the second direction and thereby uncouples the second hinge member from the cylindrical member. Consequently, when the device initially moves the cover toward the closed position at the completion of the pre-determined time interval, the second hinge member is coupled to the first hinge member and so also rotates toward the closed position. The lid thus initially moves toward the closed position at the completion of the pre-determined time interval. The device therefore initially moves both the toilet seat and the toilet lid toward the closed position. However, as the second hinge member continues to rotate in the second direction, toward the closed position, the second hinge member becomes uncoupled from the first hinge member. The lid nonetheless moves to the closed position due to gravity. Moreover, once the lid is in the closed position, the second hinge member is uncoupled from the first hinge member and the toilet lid can be opened independently of the toilet seat.

Alternatively, the coupling means of the second hinge assembly can include a recess, a lock member, and retracting means. The recess is formed along the duct of the second hinge member. The lock member is retractably mounted within a depression that is formed along the portion of the pivot rod which is positioned in the duct. The lock member has an extended portion and a camming surface. The extended portion is sized and shaped to fit within the recess and is positioned to engage the recess when the cover is in the open position and the second hinge member is in the open configuration. The retracting means retracts the lock member into the depression as the pivot rod rotates in the second direction. When both the seat and the lid are in the open position, the second hinge member is coupled to the first hinge member via the interaction between the lock member on the pivot rod and the recess in the duct of the second hinge member. Therefore, when the device initially moves the cover toward the closed position at the completion of the pre-determined time interval, the second hinge member is coupled to the first hinge member and so also rotates toward the closed position. The device thus initially moves both the toilet seat and the toilet lid toward the closed position. However, as the second hinge member continues to rotate in the second direction, toward the closed position, the second hinge member becomes uncoupled from the first hinge member. The lid nonetheless moves to the closed position due to gravity. Moreover, once in the lid is in the closed position, the second hinge member is uncoupled from the first hinge member and the toilet lid can be opened independently of the toilet seat.

The retracting means can include a tubular member that is sized to receive the pivot rod and has a first end, a second end, and a cut-out guide which is formed along the first end. The cut-out guide defines an unlocking surface that is shaped to engage the camming surface of the lock member. The tubular member is secured to the body portion of the anchor member at the second end and is positioned to encircle the pivot rod and to locate the lock member within the cut-out guide and the extended portion within the recess when the cover is in the open position and the second hinge member is in the open configuration. Consequently, when both the seat and the lid are in the open position, the second hinge member is coupled to the first hinge member via the interaction between the lock member on the pivot rod and the recess in the duct of the second hinge member. The second hinge member therefore rotates towards the closed configuration when the pivot rod initially rotates in the second direction, towards the closed position. The unlocking surface of cut-out guide engages the camming surface of the lock member as the second hinge member rod rotates from the open configuration to the closed configuration thereby removing the extended portion of the lock member from the recess and allowing the pivot rod to rotate independently of the second hinge member. Consequently, when both the seat and the lid are in the closed position, the lid is uncoupled from the seat and so can be opened independently of the seat.

Alternatively, the tubular member of the retracting means can be rotatably secured to the body portion of the anchor member so that the tubular member is rotatable between a first position and a second position. When the tubular member is in the first position, the retracting means behaves in the previously described fashion. However, when the tubular member is rotated to the second position, the lock member is located outside of the cut-out guide and the extended portion is located outside of the recess when the cover is in the open position and the second hinge member is in the open configuration. Consequently, the pivot rod rotates in the second direction independently of the second hinge member. Thus, when the tubular member is in the second position, the second hinge member remains uncoupled from the first hinge member when the seat and lid are moved to the open position. The lid therefore remains open when the device automatically moves the seat to the closed position.

The second hinge assembly can also include anti-rotation means for preventing the rotation of the second hinge member from the closed configuration to the open configuration. Consequently, the device locks both the seat and the lid in the closed position. In one embodiment the anti-rotation means includes a first hole, a tubular member, a second hole, and a catch member. The first hole is formed in the second hinge member and intersects the duct. The tubular member is sized to receive the pivot rod and has a first end and a second end. The tubular member is secured to the body portion of the anchor member at the second end and is positioned to encircle the pivot rod which extends through the tubular member. The second hole is formed in the tubular member and is positioned to align with the first hole when the second hinge member is in the closed configuration. The catch member is moveable between a locked configuration and an un-locked configuration and includes a bolt portion that is sized and shaped to fit within the first and second holes. The bolt portion is positioned within both of the first and second holes when the catch member is in the locked configuration. Consequently, the engagement between the bolt portion and the second hole prevents the second hinge member and the pivot rod from being rotated in the first direction, toward the open position. The anti-rotation means thus locks both the lid and the seat in the closed position. When the catch member is in the un-locked configuration, the bolt portion is positioned within only the first hole. Consequently, both the lid and the seat can be moved to the open position.

Alternatively, the anti-rotation means can include a first boss, a bridge member, and a locking bar. In this embodiment, the anchor member also includes a base plate that is secured to the body portion and extends outwardly from the body portion along one side thereof. The first boss is secured to the second hinge member, extends outwardly from the first hinge member, and is aligned with the base plate. The bridge member is secured to the base plate and extends upwardly from the base plate. The locking bar is slidably engaged by the bridge member and is moveable between a locked configuration and an unlocked configuration. When the locking bar is in the locked configuration, a first portion of the locking bar is substantially subjacent the first boss. Consequently, the second hinge member cannot be rotated in the first direction, toward the open position, because the portion of the locking bar is in the rotational path of the first boss and so blocks the movement of the first boss. The anti-rotation means therefore locks both the lid and the seat in the closed position. The anti-rotation means can further include a second boss that is secured to the first hinge member, extends outwardly from the second hinge member, and is aligned with the first boss. When the locking bar is in the locked configuration, a second portion of the locking bar is substantially subjacent the second boss. Consequently, the first hinge member cannot be rotated in the first direction, toward the open position, because the second of the locking bar is in the rotational path of the second boss and so blocks the movement of the second boss. The second boss and the second portion of the locking bar thus reinforce the anti-rotational interaction between the locking bar and the first boss.

The second hinge assembly thus couples the toilet lid to the device so that the device can be used to control the movement of the lid as well as the movement of the toilet seat. For example, when the second hinge assembly includes the coupling means so that the lid is coupled to the device, the device automatically closes both the toilet seat and the lid at the completion of the pre-determined time interval. Moreover, because the coupling means also uncouples the lid from the device as the second hinge is moved towards the closed configuration, the lid can be moved independently of the toilet seat when both the lid and the seat are in the closed position. In addition, when the second hinge assembly includes the anti-rotation means, the lid and the seat can be locked in the closed position. The second hinge assembly of the device thus advantageously can be used to control the movement of lid as well as the movement of the toilet seat.

The device can further include control means for controlling the rotation of the gear from the energized position to the rest position. By controlling the rotation of the gear from the energized position to the rest position, the device also controls the movement of the cover from the open position to the closed position. The device thus minimizes the potential damage that could occur, as well as excessive noise, if the cover simply fell to the closed position under the control of gravity. The control means can include a slot, a pinion, and an arcuate notched guide. The slot is formed in the gear and is positioned to trace an arcuate pathway when the gear is rotated. The pinion is rotatably mounted in the slot and so moves in the arcuate path when the gear is rotated. The arcuate notched guide is positioned and shaped to engage the pinion as the pinion moves in the arcuate path. The arcuate notched guide can be formed on a surface of the plate. Alternatively, the control means can further include a flange which is secured to the cylindrical member proximate the portion of the cylindrical member which is encircled by the gear. In this case, the arcuate notched guide can be formed on a surface of the flange. In either case, the interaction between the arcuate notched guide and the pinion effectively controls the motion of the gear as the gear rotates from the energized position to the rest position and in so doing also controls the movement of the cover from the open position to the closed position.

As noted earlier, the coupling means of the device serves to couple the hinge assembly to the timing member such that rotation of the cylindrical member in the first direction rotates the shaft from the de-activated position to the activated position. The coupling means of the device can include an aperture which is formed along the shaft proximate one end thereof and a outwardly extending pin which is mounted along chamber of the cylindrical member. The pin is shaped and sized to engage the aperture and is positioned along the chamber to engage the aperture. Because of the engagement between the aperture and the pin, the cylindrical member is rotated in the second direction as the shaft automatically rotates from the activated position to the de-activated position during the pre-determined time interval. Consequently, the cover also rotates towards the closed position during the pre-determined time interval. Alternatively, the coupling means of the device can reversibly couple the hinge assembly to the timing member such that the shaft rotates independently of the hinge assembly when the shaft automatically rotates from the activated position to the de-activated position during the pre-determined time interval. In this case, the cover does not rotate with the shaft during the pre-determined time interval but instead remains in the open position throughout the pre-determined time interval. The reversible coupling means can include an aperture, a locking pin, and a sleeve. The aperture is formed along the shaft proximate one end thereof. The locking pin is retractably mounted within a groove formed along the chamber of the cylindrical member and has a camming surface and an extended shank sized to fit within the aperture. The sleeve is sized to receive the shaft and has a first end, a second end, and a notch formed along the first end. The notch defines a first surface that is shaped to engage the shank of the locking pin and a second surface that is shaped to engage the camming surface of the locking pin. The sleeve is secured to the plate member at the second end and positioned to encircle the shaft and to locate the aperture proximate to the first surface of the notch when the shaft is in the de-activated position, the shank of the locking pin resting within the aperture of the shaft when the shaft is in the de-activated position. The cylindrical member is thus coupled to the shaft when the shaft is in the rest position via the interaction between the shank of the locking pin and the aperture in the shaft. Consequently, moving the cover from the closed position to the open position rotates both the cylindrical member and the shaft in the first direction and thereby activates the timing member. Once moved to the activated position, the shaft automatically rotates back toward the de-activated position due to the operative connection between the shaft and the timer mechanism. As the shaft rotates automatically back toward the de-activated position, the second surface of the notch engages the camming surface of the locking pin and thereby removes the shank from the aperture. Consequently, the shaft to rotates toward the de-activated position independently of the hinge assembly and the cover remains in the open position.

When the device includes the reversible coupling means, the connection means between the gear and the cylindrical member can either reversible or fixedly connect the gear and the cylindrical member. By reversibly connecting the gear to the cylindrical member the cover can be manually moved to the closed position before the completion of the pre-determined time interval without also de-activating the timer mechanism. The gear can be reversibly connected to the cylindrical member by connection means that reversibly connects the gear to the portion of the cylindrical member such that rotation of the gear from the energized position to the rest position rotates the cylindrical member in the second direction when the gear is connected to the cylindrical member, and such that the cylindrical member rotates in the second direction independent of the gear when the gear is disconnected from the cylindrical member. The reversible connection means can include a finger and a dimple. The finger is retractably mounted in a cavity formed along the channel of the gear. The finger has a locking surface and a camming surface and is moveable between an extended position and a retracted position. The dimple is formed along the portion of the cylindrical member that is encircle by the gear. The dimple defines a first surface which engages the locking surface of the finger when the finger is in the extended position. Consequently, rotation of the gear from the energized position to the rest position rotates the cylindrical member in the second direction and so automatically moves the cover toward the closed position. The dimple also defines a second surface which engages the camming surface when the cover is manually moved to the closed position and thereby moves the finger to the retracted position. Consequently, the cylindrical member rotates in the second direction independently of the gear when the finger is in the retracted position. Therefore, the cover can be manually moved to the closed position before the completion of the pre-determined time interval without also de-activating the timer mechanism. Alternatively, the connection means fixedly connect the gear to the cylindrical member. In this case, the connection means can include an outwardly projecting finger positioned along the channel of the gear and a dimple formed along the portion of the cylindrical member that is encircled by the gear. The dimple is positioned to engage the finger when the gear is in the rest position and also when the gear is in the energized position. Consequently, the cover is moved to the closed position when the reverse rotation means rotates the gear from the energized position to the rest position.

As noted previously, the connection means connect the gear to the portion of the cylindrical member such that rotation of the cylindrical member in the first direction rotates the gear from the rest position to the energized position. Thus, moving the cover to the open position rotates the gear from the rest position to the energized position and, because of the coupling means, rotates the shaft of the timing member to the activated position. In addition, the connection means connect the gear to the cylindrical member so that the rotation of the cylindrical member in the second direction can be controlled by the rotation of the gear from the energized position to the rest position. The connection means can either fixedly or reversibly connect the cylindrical member to the gear. When the connection means fixedly connects the cylindrical member to the gear, the cover is moved to the closed position when the reverse rotation means rotates the gear from the energized position to the rest position. In this case, the connection means can include an outwardly projecting finger positioned along the channel of the gear and a dimple formed along the portion of the cylindrical member that is encircled by the gear. The dimple is positioned to engage the finger when the gear is in the rest position and also when the gear is in the energized position. The gear therefore remains connected to the cylindrical member throughout the pre-determined time interval and so the cover is automatically moved to the closed position at the completion of the pre-determined time interval. Alternatively, the connection means can reversibly connect the gear and the cylindrical member so that the cover can be manually moved to the closed position before the completion of the pre-determined time interval without also de-activating the timer mechanism. The gear can be reversibly connected to the cylindrical member by connection means that reversibly connects the gear to the portion of the cylindrical member such that rotation of the gear from the energized position to the rest position rotates the cylindrical member in the second direction when the gear is connected to the cylindrical member, and such that the cylindrical member rotates in the second direction independent of the gear when the gear is disconnected from the cylindrical member. The reversible connection means can include a finger and a dimple. The finger is retractably mounted in a cavity formed along the channel of the gear. The finger has a locking surface and a camming surface and is moveable between an extended position and a retracted position. The dimple is formed along the portion of the cylindrical member that is encircled by the gear. The dimple defines a first surface which engages the locking surface of the finger when the finger is in the extended position. Consequently, rotation of the gear from the energized position to the rest position rotates the cylindrical member in the second direction and so automatically moves the cover toward the closed position. The dimple also defines a second surface which engages the camming surface when the cover is manually moved to the closed position and thereby moves the finger to the retracted position. Consequently, the cylindrical member rotates in the second direction independently of the gear when the finger is in the retracted position. The reversible connection means thus permits the cover to be automatically closed by the device or manually closed. When the finger is in the extended position, the gear remains connected to the cylindrical member and the device therefore automatically moves the cover to the closed position at the completion of the predetermined time interval. However, if the cover is manually moved towards the closed position during the pre-determined time interval, the second surface of the dimple engages the camming surface of the finger and thereby retracts the finger into the recess and disconnects the gear from the cylindrical member. Consequently, the cover can be manually closed during the pre-determined time interval without disarming the timer mechanism. When the device includes the reversible connection means the hinge assembly can further include a flange, a pinion, two slots, and two arcuate notched guides that cooperate to control the rotation of the of the gear from the energized position to the rest position and thereby controlling the movement of the cover from the open position to the closed position. The flange is secured to the cylindrical member proximate the portion of the cylindrical member which is encircled by the gear. The first slot is formed in the gear and is positioned to trace an arcuate pathway when the gear is rotated. The pinion is rotatably mounted in the slot and so moves in the arcuate pathway when the gear is rotated. The first arcuate notched guide is formed on a surface of the plate member and is positioned and shaped to engage the pinion as the pinion rotates in the arcuate path. The second slot is formed on the surface of the plate member and is positioned to engage the gear when the gear is in the energized position. The second arcuate notched guide is formed on a surface of the flange and is also positioned and shaped to engage the pinion as the pinion rotates in the arcuate path. When the gear is connected to the cylindrical member by the reversible connection means, the first and second arcuate notched guides engage the pinion so that the automatic movement of the cover to the closed position at the completion of the pre-determined time interval is controlled. However, when the reversible connection means disconnects the gear from the cylindrical member, as occurs when the cover is manually rotated to the closed position, the gear is engaged by the second slot and by the second arcuate notched guide. Thus, since the gear rotates within the second slot as the cover is manually closed, the cover can be manually closed without disarming the timing mechanism.

The invention is also directed to a hinge assembly that is used with a conventional toilet which has a bowl, a seat, and a lid. The hinge assembly includes a first hinge member, a pivot rod, an anchor member, and a second hinge member. The first hinge member is rotatable in a first direction and in a second direction. The pivot rod is secured to the first hinge member and rotates in the first and second directions concurrently with the first hinge member. The anchor member has a body portion and a bore extending through the body portion. The bore is sized and shaped to accommodate the pivot rod which extends from the first hinge member through the bore. The second hinge member has a duct that is sized and shaped to receive a portion of the pivot rod, the portion of the pivot rod being positioned within the duct. The second hinge member is rotatably coupled to the pivot rod and is rotatable between a closed configuration and an open configuration. The hinge assembly also includes securement means for securing the anchor member to the toilet bowl. Since the pivot rod rotates concurrently with the first hinge member, the movement of both hinge members can be readily controlled. In addition, the second hinge member can be coupled to the pivot rod so that the second hinge member also rotates concurrently with the first hinge member.

The hinge assembly can include anti-rotation means for preventing the rotation of the second hinge member from the closed configuration to the open configuration. The anti-rotation means of the replacement hinge assembly thus locks the toilet seat and the toilet lid in the closed position. In one embodiment the anti-rotation means includes a first hole, a tubular member, a second hole, and a catch member. The first hole is formed in the second hinge member and intersects the duct. The tubular member is sized to receive the pivot rod and has a first end and a second end. The tubular member is secured to the body portion of the anchor member at the second end and is positioned to encircle the pivot rod which extends through the tubular member. The second hole is formed in the tubular member and is positioned to align with the first hole when the second hinge member is in the closed configuration. The catch member is moveable between a locked configuration and an un-locked configuration and includes a bolt portion that is sized and shaped to fit within the first and second holes. The bolt portion is positioned within both of the first and second holes when the catch member is in the locked configuration. Consequently, the engagement between the bolt portion and the second hole prevents the second hinge member and the pivot rod from being rotated in the first direction, toward the open position. The anti-rotation means thus locks both the lid and the seat in the closed position. When the catch member is in the un-locked configuration, the bolt portion is positioned within only the first hole. Consequently, both the lid and the seat can be moved to the open position.

In a second embodiment, the first hinge member is secured to the toilet lid. In this case, the anti-rotation means includes a first hole, a second hole, and a catch member that is moveable between a locked configuration and an un-locked configuration. The first hole is formed in the body portion of the anchor member and is positioned to intersect the bore. The second hole is formed in the pivot rod and is positioned to be aligned with the first hole when the first hinge member is in the first position. The catch member has a bolt portion that is sized and shaped to fit with the first and second holes. The bolt portion is positioned within both the first and second holes when the catch member is in the locked configuration. Consequently, neither the lid nor the seat can be opened. However, when the catch member is in the un-locked configuration, the bolt portion is positioned only within the first hole and so the lid and the seat can both be opened.

In a third embodiment, the anti-rotation means can include a first boss, a bridge member, and a locking bar. In this embodiment, the anchor member also includes a base plate that is secured to the body portion and extends outwardly from the body portion along one side thereof. The first boss is secured to the first hinge member, extends outwardly from the first hinge member, and is aligned with the base plate. The bridge member is secured to the base plate and extends upwardly from the base plate. The locking bar is slidably engaged by the bridge member and is moveable between a locked configuration and an unlocked configuration. When the locking bar is in the locked configuration, a first portion of the locking bar is substantially subjacent the first boss. Consequently, the second hinge member cannot be rotated in the first direction, toward the open position, because the portion of the locking bar is in the rotational path of the first boss and so blocks the movement of the first boss. The anti-rotation means therefore locks both the lid and the seat in the closed position. The anti-rotation means can further include a second boss that is secured to the second hinge member, extends outwardly from the second hinge member, and is aligned with the first boss. When the locking bar is in the locked configuration, a second portion of the locking bar is substantially subjacent the second boss. Consequently, the first hinge member cannot be rotated in the first direction, toward the open position, because the second of the locking bar is in the rotational path of the second boss and so blocks the movement of the second boss. The second boss and the second portion of the locking bar thus reinforce the anti-rotational interaction between the locking bar and the first boss.

The hinge assembly can also include coupling means for coupling the second hinge member to the first hinge member so that the second hinge member rotates towards the closed configuration when the first hinge member rotates in the second direction. The coupling means of the replacement hinge assembly therefore couples the lid hinge to the seat hinge so that the lid closes simultaneously with the seat. The coupling means of the second hinge assembly can include an elongated track, a latch, biasing means, a latch guide, and a camming surface. The elongated track is formed in the pivot rod and has a first end and a second end. The second end is positioned at least partially along the portion of the pivot rod that is positioned within the duct of the second hinge member. The latch is slidably positioned within the elongated track and includes a first portion and a second portion. The first portion has an outer surface that is shaped to conform with the shape of the pivot rod. The second portion is attached to the first portion intermediate the first portion and the second end of the elongated track and extends outwardly from the elongated track. The biasing means biases the latch toward the first end of the track. The latch guide is formed in the second hinge member and is positioned to intersect the duct and shaped to accommodate the second portion of the latch. The camming surface is formed within the bore of the anchor member and is positioned and shaped to engage the second portion of the latch. The camming surface urges the second portion of the latch into the latch guide when the first hinge member rotates in the first direction and thereby couples the second hinge member to the first hinge member. The biasing means urges the latch towards the first end of the elongated track when the first hinge member rotates in the second direction and thereby uncouples the second hinge member from the first hinge member. Consequently, when first hinge member is rotated in the second direction, the second hinge member is coupled to the first hinge member and so rotates toward the closed configuration. However, as the second hinge member continues to rotate in the second direction, toward the closed position, the second hinge member becomes uncoupled from the first hinge member. Consequently, the second hinge member can be rotated independently of the first hinge member when the second hinge member is in the closed configuration.

Alternatively, the coupling means of the hinge assembly can include a recess, a lock member, and retracting means. The recess is formed along the duct of the second hinge member. The lock member is retractably mounted within a depression that is formed along the portion of the pivot rod which is positioned in the duct. The lock member has an extended portion and a camming surface. The extended portion is sized and shaped to fit within the recess and is positioned to engage the recess when the cover is in the open position and the second hinge member is in the open configuration. The retracting means retracts the lock member into the depression as the pivot rod rotates in the second direction. When both the seat and the lid are in the open position, the second hinge member is coupled to the first hinge member via the interaction between the lock member on the pivot rod and the recess in the duct of the second hinge member. Therefore, when seat and lid are open, the second hinge member is coupled to the first hinge member and so the lid rotates toward the closed position when the seat is moved toward the closed position. However, as the second hinge member continues to rotate in the second direction, toward the closed position, the second hinge member becomes uncoupled from the first hinge member. The lid nonetheless moves to the closed position due to gravity. Moreover, once in the lid is in the closed position, the second hinge member is uncoupled from the first hinge member and the toilet lid can be opened independently of the toilet seat.

The retracting means can include a tubular member that is sized to receive the pivot rod and has a first end, a second end, and a cut-out guide which is formed along the first end. The cut-out guide defines an unlocking surface that is shaped to engage the camming surface of the lock member. The tubular member is secured to the body portion of the anchor member at the second end and is positioned to encircle the pivot rod and to locate the lock member within the cut-out guide and the extended portion within the recess when the cover is in the open position and the second hinge member is in the open configuration. Consequently, when both the seat and the lid are in the open position, the second hinge member is coupled to the first hinge member via the interaction between the lock member on the pivot rod and the recess in the duct of the second hinge member. The second hinge member therefore rotates towards the closed configuration when the pivot rod initially rotates in the second direction, towards the closed position. The unlocking surface of cut-out guide engages the camming surface of the lock member as the second hinge member rod rotates from the open configuration to the closed configuration thereby removing the extended portion of the lock member from the recess and allowing the pivot rod to rotate independently of the second hinge member. Consequently, when both the seat and the lid are in the closed position, the lid is uncoupled from the seat and so can be opened independently of the seat.

Alternatively, the tubular member of the retracting means can be rotatably secured to the body portion of the anchor member so that the tubular member is rotatable between a first position and a second position. When the tubular member is in the first position, the retracting means behaves in the previously described fashion. However, when the tubular member is rotated to the second position, the lock member is located outside of the cut-out guide and the extended portion is located outside of the recess when the second hinge member is in the open configuration. Consequently, the pivot rod rotates in the second direction independently of the second hinge member. Thus, when the tubular member is in the second position, the second hinge member remains uncoupled from the first hinge member when the seat and lid are moved to the open position. The lid therefore remains open when the seat is moved to the closed position.

DETAILED DESCRIPTION

Figure 1:
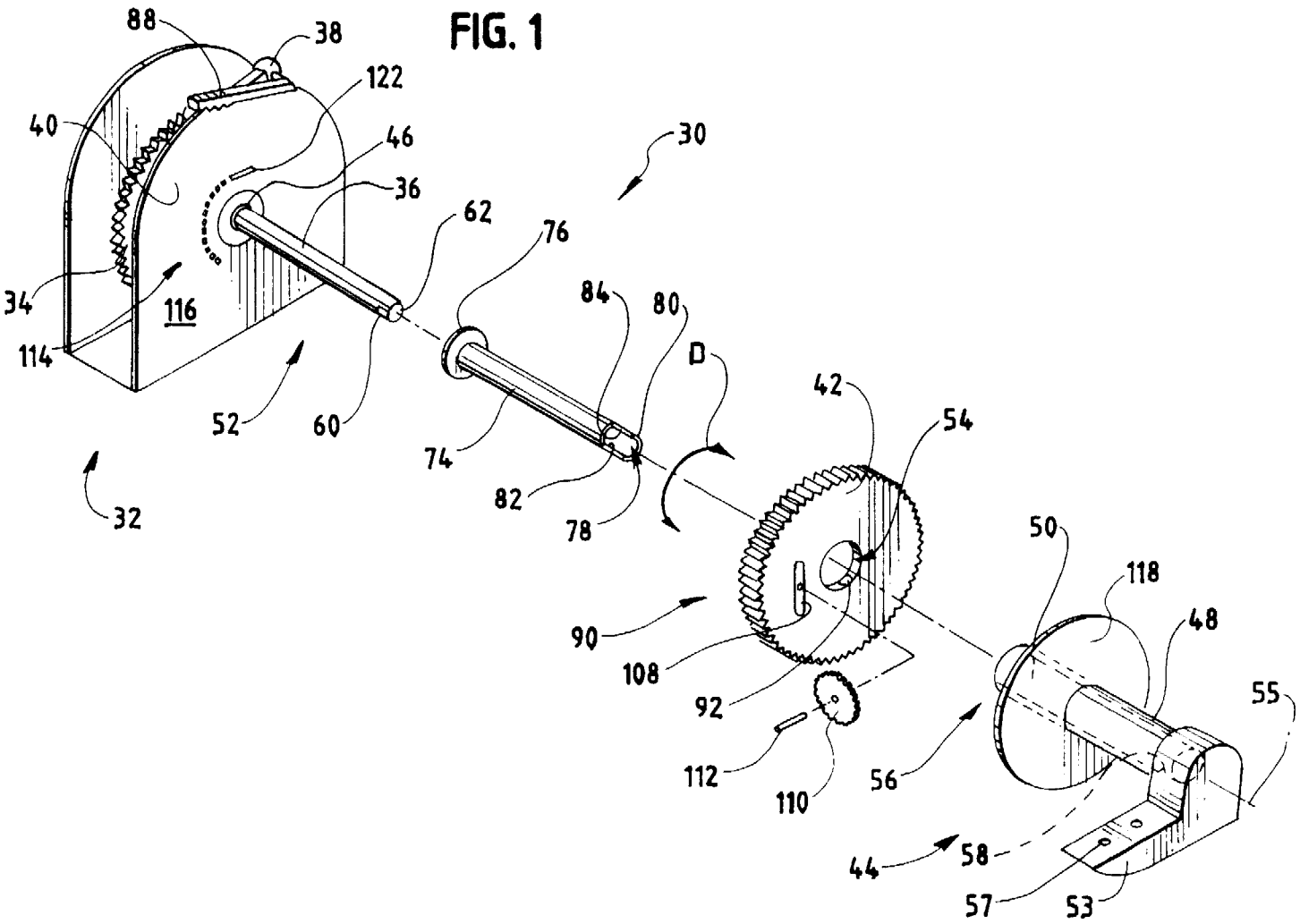
FIG. 1 is a front perspective exploded view of an automatic closing device according to the invention.

Turning now to the drawings in which like reference numbers denote like elements throughout, FIGS. 1, 2, 8, and 9 illustrate an automatic closing device 30 according to the invention. The device 30 is used for closing the cover of a container of the type having a cover that is hingedly mounted on a body and is moveable between a closed position in which the cover is substantially flush with the body and an open position in which the cover is pivotally raised above the body. An example of such a container is a conventional toilet 130 (shown in FIGS. 15 and 16) that includes a toilet seat 132 which is pivotally mounted by hinges 136 on a toilet bowl 140. The device 30 automatically moves the seat 132 from an open position (shown in FIG. 15) to a closed position (shown in FIG. 16).

Figure 2:
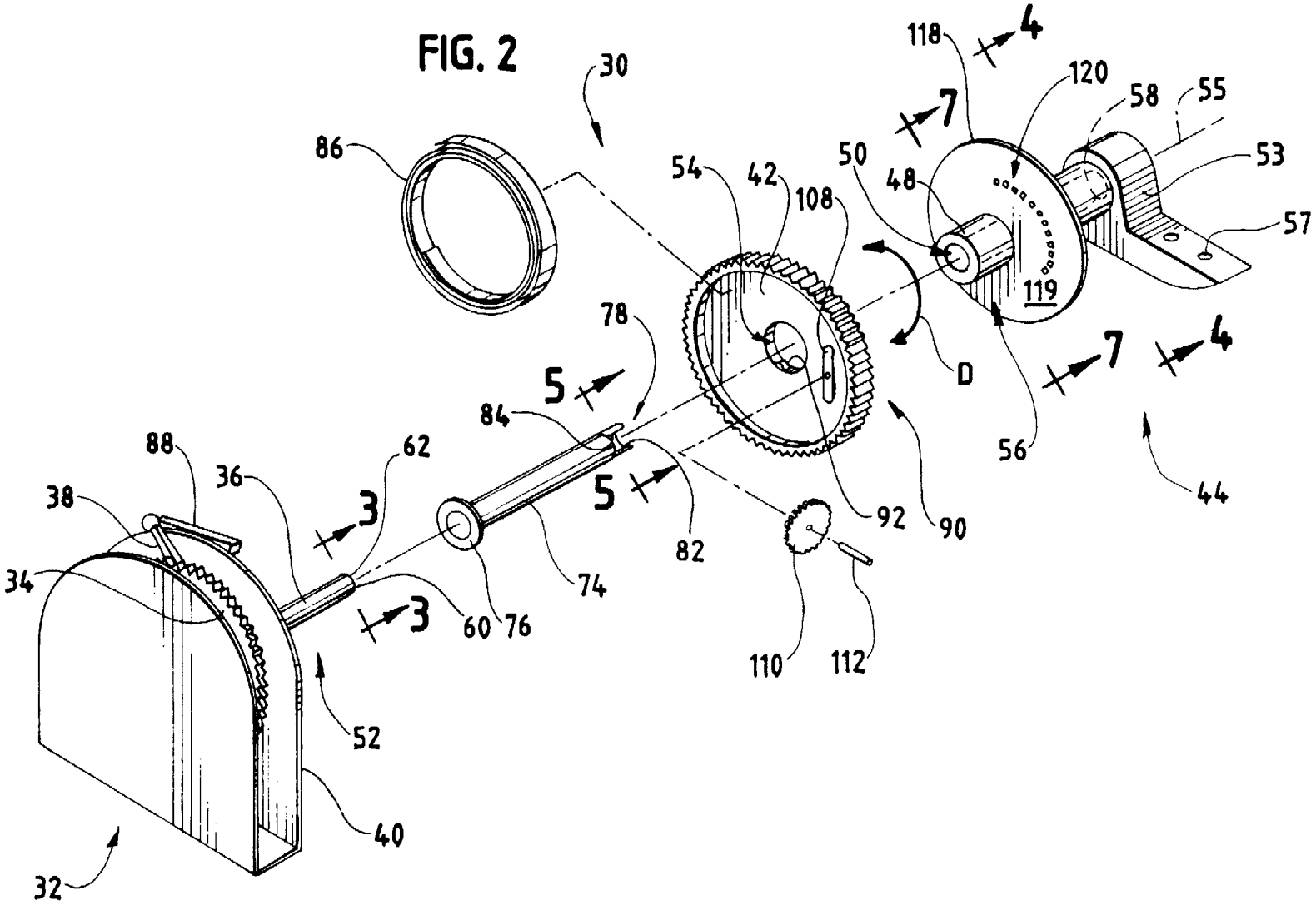
FIG. 2 is a rear perspective exploded view of the automatic closing device shown in FIG. 1.
Figure 9:
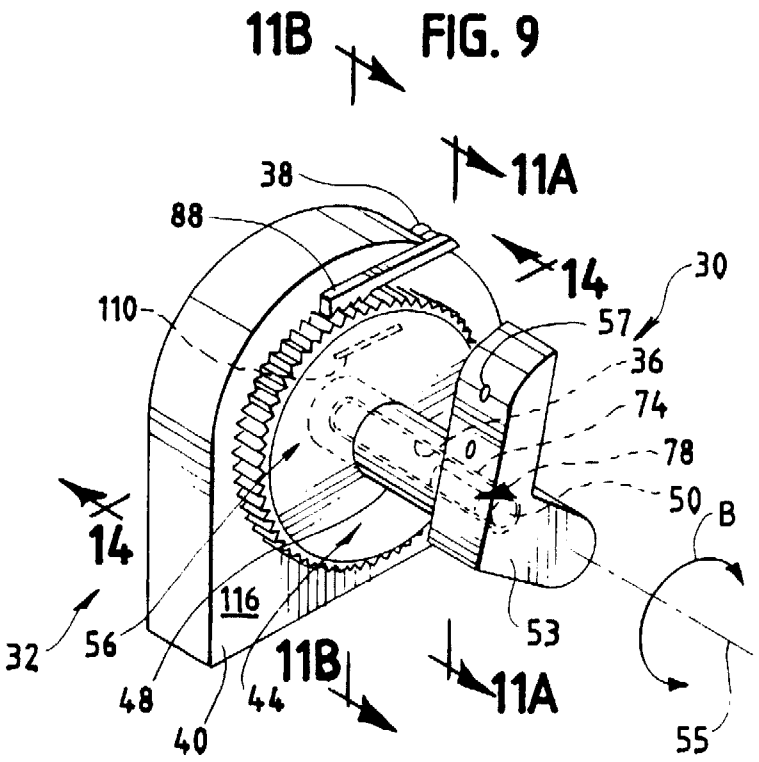
FIG. 9 is the same view as FIG. 8 and shows the relative placement of the components of the device shown in FIGS. 1 and 2 when the cylindrical member is rotated in a first direction to a second position.

The device 30 is used in combination with a conventional timing member 32 which can be set to measure a predetermined time interval. The timing member 32, which is best seen in FIGS. 1 and 2, preferably is a conventional mechanical timer of the type having cooperating timer gears 34 that rotate for a period equal to the pre-determined time interval, a shaft 36 that activates the timer gears 34, and an arm 38 that signals when the pre-determined time interval is complete. The shaft 36, which is operatively connected to the timer gears 34, is rotatable between a de-activated position and an activated position. FIGS. 1, 2, 8, and 10A show the shaft 36 in the de-activated position and FIGS. 9 and 11A shows the shaft 36 in the activated position. The arm 38 is also operatively connected to the timer gears 34 and is moveable between a retracted position and an extended position. When the shaft 36 is in the de-activated position, the timer gears 34 are substantially motionless and the arm 38 is in the extended position shown in FIG. 1, 2, 8, and 17. Rotating the shaft 36 to the activated position activates the timer gears 34 and moves the arm 38 to the retracted position, as best seen in FIG. 9. During the pre-determined time interval, the shaft 36 rotates back to the de-activated position, due to its operative connection to the timer gears 34. When the pre-determined time interval is complete, the shaft 36 is in the de-activated position and the arm 38 moves to the extended position. Mechanical timing devices, such as the timing member 32, are well known and are used, for example, as conventional mechanical timers in which the arm 38 strikes a bell when the arm 38 moves to the extended position at the completion of the pre-determined time interval.

Figure 8:
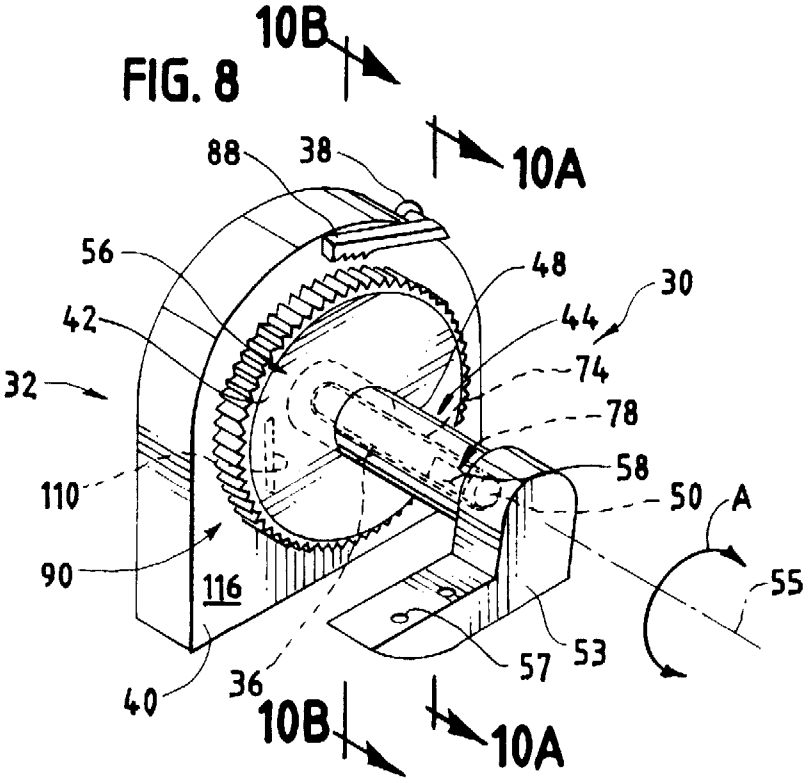
FIG. 8 is a side perspective view of the assembled device shown in FIGS. 1 and 2 and shows the relative placement of the components of the device when the cylindrical member is in a first position.

The device 30 includes a plate member 40, a rotatable gear 42, and a rotatable hinge assembly 44. The plate member 40 is secured to the timing member 32 and includes an opening 46 through which the shaft 36 of the timing member 32 extends. The hinge assembly 44 includes a cylindrical member 48 which is rotatable in a first direction denoted by curve A in FIGS. 8 and 10A. The cylindrical member 48 is also rotatable in a second direction, opposite the first direction. The second direction of rotation is denoted by curve B in FIGS. 9 and 11A. The cylindrical member 48 has a chamber 50 that is sized to receive a portion 52 of the shaft 36. When the device 30 is assembled, as shown in FIGS. 8 and 9, the portion 52 of the shaft 36 is positioned within the chamber 50. In the preferred embodiment shown in FIGS. 1, 2, 8, and 9, the gear 42 is positioned intermediate the timing member 32 and the hinge assembly 44. The gear 42 is rotatable between a rest position, shown in FIG. 8, and an energized position, shown in FIG. 9. The gear 42 includes a centrally-positioned channel 54 which is sized to encircle a portion 56 of the cylindrical member 48 when the device 30 is assembled, as best seen in FIGS. 8 and 9. A cover hinge member 53 is secured to the cylindrical member 48 opposite the portion 52 of the shaft 36. The cover hinge member 53 rotates concurrently with the cylindrical member 48. In use, the hinge member 53 is also secured to the bottom surface 134 of the cover or seat 132 so that the cylindrical member 48 is aligned with the pivot axis 55 of the cover 132. The hinge member is attached to the cover 132 by conventional attachment devices, such as bolts 57 or adhesive. Consequently, the cover 132 moves toward open position when the cylindrical member 48 rotates in the first direction, along curve A, and the cover 132 moves towards the closed position when the cylindrical member 48 moves in the second direction, along curve B. The shaft 36, the gear 42, the hinge assembly 44, and the cover hinge assembly 53 thus cooperate to automatically move the cover 132 (shown in FIGS. 15 and 16) from the open position (shown in FIG. 15) to the closed position (shown in FIG. 16) at the completion of the pre-determined time interval.

The device 30 also includes a locking pin 58 that cooperates with an aperture 60 formed on the shaft 36 to couple the hinge assembly 44 to the timing member 32. The aperture 60 is formed proximate the outer end 62 of the shaft 36, as seen in FIGS. 1 and 2, and is sized and shaped to engage at least a portion 64 of the locking pin 58 (shown in FIG. 4). In the preferred embodiment the aperture 60 is formed as a longitudinal slit along the shaft 36. Alternatively, the aperture 60 can be formed as a bore hole. The locking pin 58 is affixed to the chamber 50 of the cylindrical member 48 and is positioned along the chamber 50 so that the aperture 60 engages the portion 64 of the locking pin 58 when the device 30 is assembled and the shaft 36 is in the de-activated position. Because the locking pin 58 couples the hinge assembly 44 to the shaft 36 of the timing member 32 via the aperture 60, rotating the hinge assembly 44 in the direction shown as curve A in FIGS. 8 and 10A simultaneously rotates the shaft 36 from the de-activated position to the activated position and activates the timing member 32.

Figure 5:
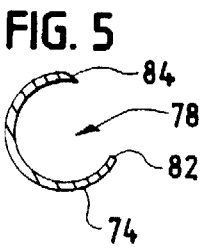
FIG. 5 is a cross-sectional view along line 5—5 in FIG. 2 and illustrates a portion of the sleeve which forms a part of the device shown in FIGS. 1 and 2.
Figure 4:
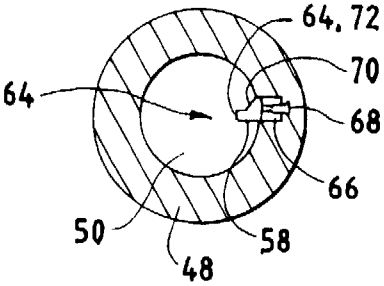
FIG. 4 is a cross-sectional view along line 4—4 in FIG. 2 and illustrates a portion of the cylindrical member which forms a part of the device shown in FIGS. 1 and 2.
Figure 3:
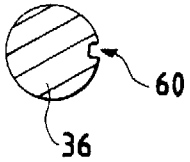
FIG. 3 is a cross-sectional along line 3—3 FIG. 2 and illustrates a portion of the shaft which forms a part of the device shown in FIGS. 1 and 2.

In the preferred embodiment, the hinge assembly 44 is reversibly coupled to the timing member 32 so that the shaft 36 can rotate independently of the hinge assembly 44 during the pre-determined time interval. The preferred embodiment therefore also includes a sleeve 74 that cooperates with the shaft 36 and the locking pin 58 to reversibly couple the hinge assembly 44 to the timing member 32. The sleeve 74 is sized to receive the shaft 36 and is secured at one end 76 to the plate member 40 so that the shaft 36 extends through the sleeve 74 when the device 30 is assembled. A notch 78 which cooperates with the locking pin 58 is formed at the other end 80 of the sleeve 74. FIGS. 3, 4, and 5 show the relative positioning of the shaft 36, the cylindrical member 48, and the sleeve 74 when the shaft 36 is in the de-activated position. In the preferred embodiment the locking pin 58 is retractably mounted along the chamber 50 so that the hinge assembly 44 is reversibly coupled to the shaft 36. FIG. 4 illustrates the preferred embodiment of the locking pin 58 which is positioned within a groove 66 that is formed along the chamber 50 of the cylindrical member 48. The locking pin 58 is mounted to the cylindrical member 48 by a spring 68 that permits the locking pin 58 to be reversibly retracted within the groove 66. The locking pin 58 includes an extended shank 72 that cooperates with the aperture 60 in the shaft 36 (shown in FIG. 3) to couple the hinge assembly 44 to the shaft 36. The locking pin 58 also includes a camming surface 70 that cooperates with the sleeve 74 to uncouple the hinge assembly 44 from the shaft 36. As shown in FIG. 5, the notch 78 defines a first surface 82 that is shaped to engage the shank 72 of the locking pin 58. The notch 78 also defines a second surface 84 that is shaped to engage the camming surface 70 of the locking pin 58. As is described in greater detail with reference to FIGS. 10A and 10B through 12A and 12B, when the shaft 36 is rotated from the de-activated position to the activated position, the second surface 84 of the notch 78 engages the camming surface 70 of the locking pin 58 and urges the locking pin 58 into the groove 66 thereby uncoupling the hinge assembly 44 from the shaft 36 so that the shaft 36 can rotate independently of the hinge assembly 44. By uncoupling the shaft 36 from the hinge assembly 44 during the pre-determined time interval, the cover 132 does not automatically rotate concurrently with the shaft 36 and so does not automatically rotate towards the closed position until the completion of the pre-determined time interval.

Alternatively, the hinge assembly 44 can be coupled to the timing member 32 so that the shaft 36 and the cylindrical member 48 can only rotate concurrently, in which case the cover 132 (shown in FIGS. 15 and 16) would continuously pivot towards the closed position during the pre-predetermined time interval. Any coupling mechanism that irreversibly connects the shaft 36 to the cylindrical member 48 would cause the shaft 36 and the cylindrical member 48 to rotate concurrently. For example, the locking pin 58 could be non-retractably secured to the cylindrical member 48 such that the locking pin 58 protrudes from the cylindrical member 48. In this case, the locking pin 58 would be substantially irreversibly engaged by the aperture 60 of the shaft 36 and the cylindrical member 48 would rotate concurrently with the shaft 36. The hinge assembly 44 could also be relatively irreversibly coupled to the shaft 36 by adjusting the fit between the cylindrical member 48 and the shaft 36 to create a snap-fit relationship.

Figure 10B:
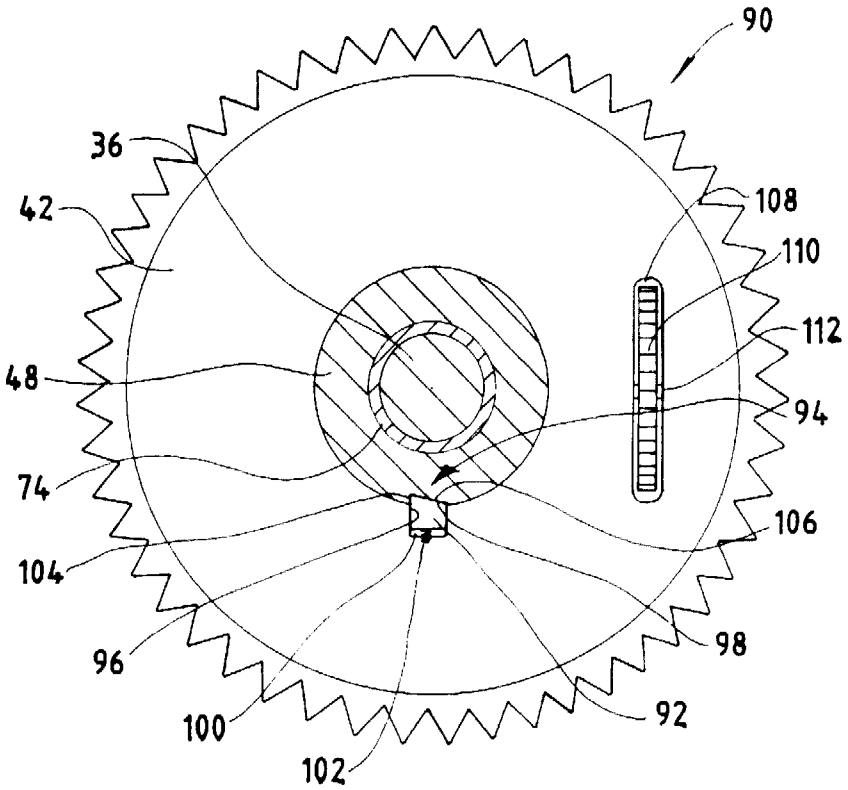
FIG. 10B is a cross-sectional view along line 10B—10B in FIG. 8 and shows the relative positions of the gear and the cylindrical member when the gear is in a rest position.
Figure 10A:
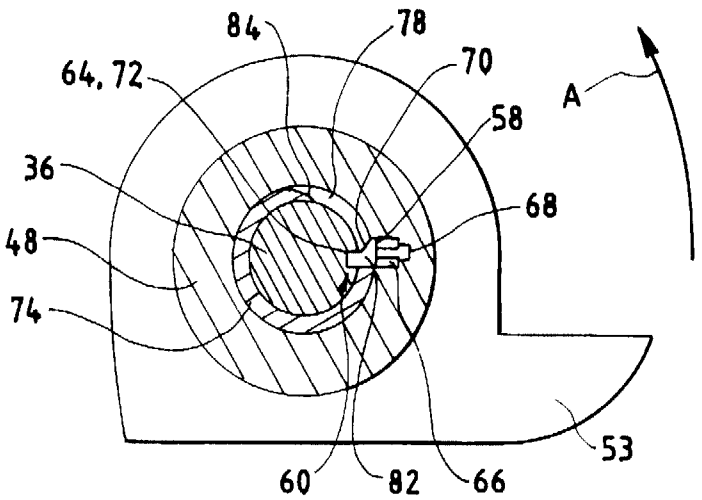
FIG. 10A is a cross-sectional view along line 10A—10A in FIG. 8 and shows the relative positions of the shaft and the cylindrical member when the shaft is in a de-activated position.

Referring back to FIGS. 1, 2, 8, and 9, the gear 42 is connected to the cylindrical member 48 of the hinge assembly 44 so that the gear 42 rotates with the hinge assembly 44 when the hinge assembly 44 is rotated in the direction shown as curve A in FIGS. 8 and 10A. As best seen in FIG. 2, a spring 86 is secured to the gear 42 to bias the gear 42 to a rest configuration which corresponds to the de-activated position of the shaft 36. When the hinge assembly 44 is rotated along curve A, the concurrent rotation of the gear 42 energizes the gear 42 either through the compression or expansion of the spring 86. The energized gear 42 thus has a tendency to rotate back to the rest position. As noted previously, the energized position of the gear 42 corresponds to the activated position of the shaft 36 and consequently the arm 38 is in the retracted position when the gear 42 is in the energized position. The device 30 includes a notched rack 88 that retains the gear 42 in the energized position during the pre-determined time interval. The notched rack 88 is secured to the arm 38 and is shaped to engage a portion 90 of the gear 42 thereby retaining the gear 42 in the energized position during the pre-determined time interval. At the completion of the pre-determined time interval the arm 38 and the notched rack 88 move to the extended position and release the gear 42 which, because of the bias of the spring 86, rotates to the rest position thus causing the hinge assembly 44 to rotate in the direction shown as curve B in FIGS. 9 and 11A.

Figure 7:
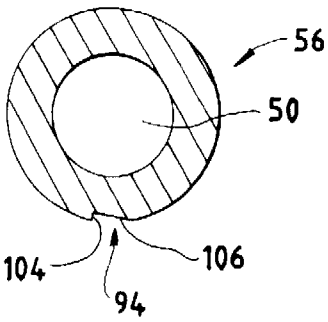
FIG. 7 is a cross-sectional view along line 7—7 in FIG. 2 and illustrates a second portion of the cylindrical member shown in FIGS. 1, 2, and 4.
Figure 6:
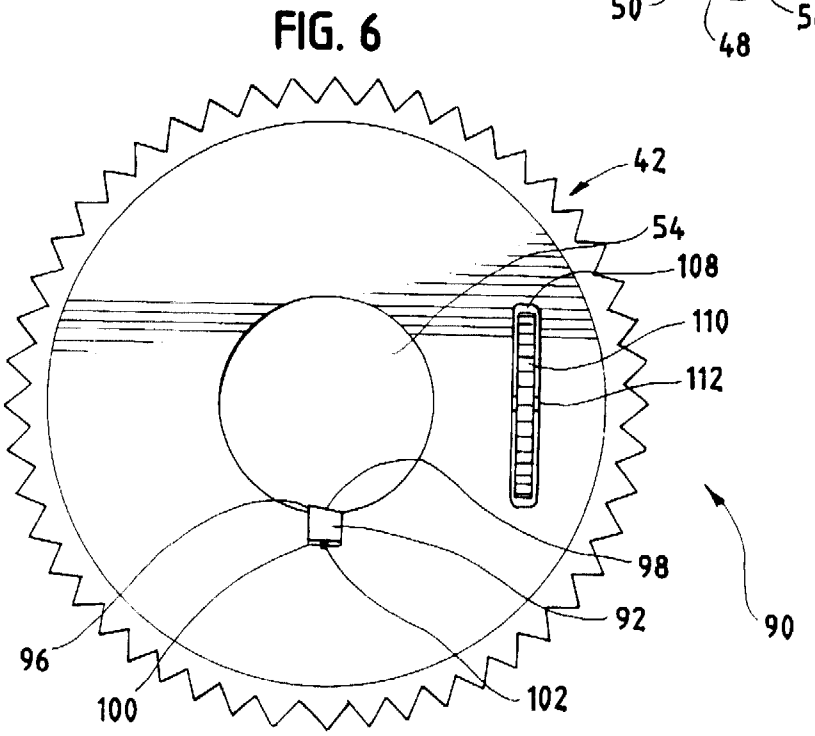
FIG. 6 is a side plan view of the gear which forms a part of the device shown in FIGS. 1 and 2.

The gear 42 is connected to the hinge assembly 44 by a finger 92 that projects outwardly from the channel 54 of the gear 42 and engages a dimple 94 (shown in FIG. 7) formed along the cylindrical member 48. Alternatively, the gear 42 could be connected to the hinge assembly 44 by a snap-fit relationship between the channel 54 and the portion 56 of the cylindrical member 48. A rigid connection between the gear 42 and the cylindrical member 48 ensures that the hinge assembly 44 and the gear 42 rotate concurrently. In the preferred embodiment, however, the gear 42 is reversibly connected to the hinge assembly 44 so that the hinge assembly 44 can rotate independently of the gear 42 thereby permitting manual movement of the cover 132 (shown in FIGS. 15 and 16) to the closed position. FIGS. 6 and 7 show the preferred embodiment of the finger 92 and dimple 94, respectively. In the preferred embodiment, the finger 92 is positioned within a cavity 100 formed along the channel 54 of the gear 42. The finger 92 is mounted to the channel 54 by a spring 102 and therefore is moveable between an extended position and a retracted position. The finger 92 includes a locking surface 96 that operates to connect the gear 42 to the hinge assembly 44. The finger 92 also includes a camming surface 98 that operates to disconnect the gear 42 from the hinge assembly 44 when the cover 132 is manually moved to the closed position. The dimple 94 is formed along the portion 56 of the cylindrical member 48 and defines a first surface 104 and a second surface 106. The first surface 104 engages the locking surface 96 of the finger 92 when the gear 42 is in the rest position shown in FIGS. 1, 2, 6, and 8. Rotating the cylindrical member 48 in the directed indicated as curve A in FIGS. 8 and 10A thus rotates the gear 42 from the rest position to the energized position, as is explained in more detail in reference to FIGS. 10A and 10B. In addition, if the cover 132 is not manually lowered during the pre-determined time interval, the locking surface 96 and the first surface 104 remain engaged so that the cover 132 is automatically lowered to the closed position when the gear 42 rotates back to the rest position at the completion of the pre-determined time interval, as is explained in reference to FIGS. 11A, 11B, 12A, and 12B. However, if the cover 132 is manually moved to the closed position during the pre-determined time interval, the gear 42 remains in the energized position due to the retaining relationship of the notched rack 88. Manual movement of the cover 132 towards the closed position rotates the cylindrical member 48 in the direction shown as curve B in FIGS. 9 and 11A so that the second surface 106 of the dimple 94 engages the camming surface 98 of the finger 92, urges the finger 92 into the retracted position within the cavity 100, and thus disconnects the cylindrical member 48 from the gear 42, as is explained in reference to FIGS. 13A and 13B.

The interactions of the coupling mechanism between the shaft 36 and the cylindrical member 48 and of the connection mechanism between the gear 42 and the cylindrical member 48 are now explained in reference to FIGS. 10A and 10B through 13A and 13B. FIGS. 10A and 10B illustrate the concurrent spatial relationships among the components of the device 30 when the hinge assembly 44 is in a position that corresponds to the closed position of the cover 132 (as shown in FIG. 16). FIG. 10A shows the relationship between the shaft 36 and the cylindrical member 48 when the shaft 36 is in the deactivated position shown in FIG. 8. Similarly, FIG. 10B shows the relationship between the gear 42 and the cylindrical member 48 when the gear 42 is in the rest position shown in FIG. 8. As seen in FIGS. 10A and 10B, the de-activated position of the shaft 36 corresponds with the rest position of the gear 42. When the shaft 36 is in the de-activated position the aperture 60 in the shaft 36 is aligned with the first surface 82 of the notch 78 in the sleeve 74 and with the shank 72 of the locking pin 58, as seen in FIG. 10A. The spring 68 therefore urges the locking pin 58 outwardly from the groove 66 and the shank 72 is engaged by the aperture 60. As seen in FIG. 10B, when the gear 42 is in the de-activated position the dimple 94 in the cylindrical member 48 is aligned with the outwardly projecting finger 92 of the gear 42 so that the first surface 104 of the dimple 94 engages the locking surface 96 of the finger 92. At this point, if the hinge assembly 44 is rotated along curve A as would occur, for example, when the cover 132 is pivoted toward the open position (shown in FIG. 15), the engagement between the locking pin 58 of the cylindrical member 48 and the aperture 60 of the shaft 36 rotates the shaft 36 along curve A and the engagement between the dimple 94 on the cylindrical member 48 and the finger 92 on the gear 42 also rotates the gear 42 along curve A. The notch 78, however, does not rotate with the gear 42 and the cylindrical member 48 of the hinge assembly 44 because the sleeve 74 is fixedly secured to the plate member 40 and does not rotate.

Figure 11B:
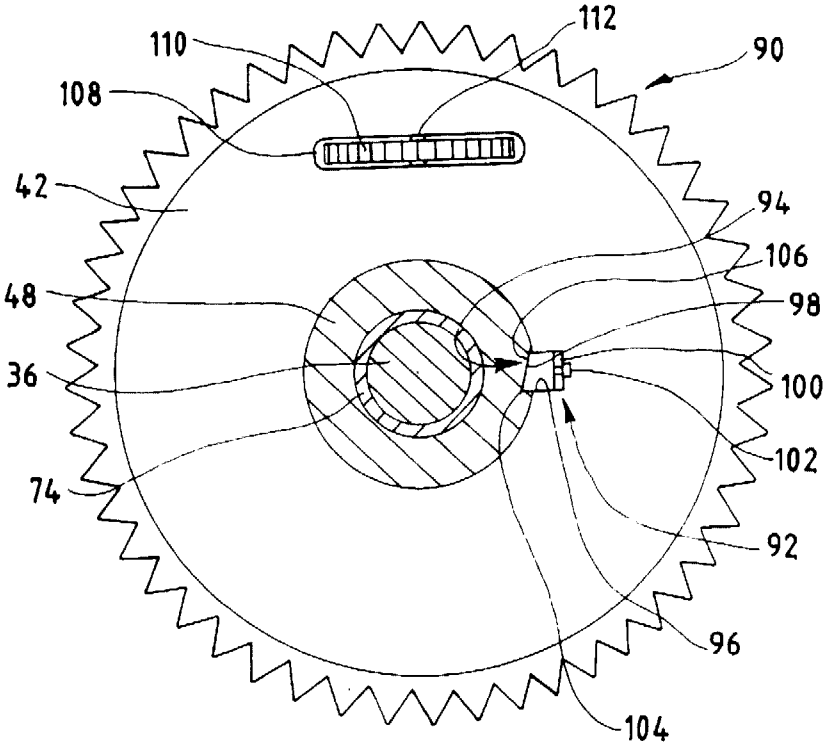
FIG. 11B is a cross-sectional view along line 11B—11B in FIG. 9 and shows the relative positions of the gear and the cylindrical member when the gear is in an energized position.
Figure 11A:
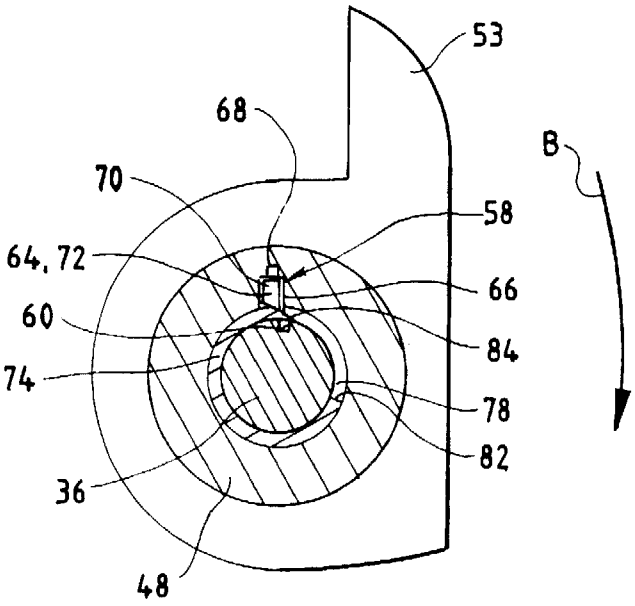
FIG. 11A is a cross-sectional view along line 11A—11A in FIG. 9 and shows the relative positions of the shaft and the cylindrical member when the shaft is in an activated position.

Because of the engagement of the locking pin 58 by the aperture 60 and of the finger 92 by the dimple 94, rotating the cylindrical member 48 completely along curve A to the configuration shown in FIG. 9 moves the shaft 36, the cylindrical member 48, and the gear 42 into the concurrent positions shown in FIGS. 11A and 11B. This would occur, for example, when the cover 132 is pivoted to the open position (shown in FIG. 15). Rotating the cylindrical member 48 along curve A therefore also rotates the shaft 36 to the activated position and activates the timing member 32. In addition, rotating the shaft 36 to the activated position uncouples the shaft 36 from the cylindrical member 48 so that the shaft 36 rotates independently of the hinge assembly 44 during the pre-determined time interval. As the cylindrical member 48 rotates along curve A, the locking pin 58 is brought into contact with the second surface 84 of the notch 78. When this occurs the second surface 84 of the notch 78 engages the camming surface 70 of the locking pin 58 and urges the locking pin 58 into the groove 66. As the cylindrical member 48 continues to rotate along curve A, the interaction between the second surface 84 and the camming surface 70 retracts the locking pin 58 into the groove 66 and disengages the shank 72 from the aperture 60, as shown in FIG. 11A. At the same time, due to the engagement between the projecting finger 92 on the gear 42 and the dimple 94 in the chamber 50 of the cylindrical member 48, rotation of the cylindrical member 48 along curve A also rotates the gear 42 along curve A to the position shown in FIG. 11B. At this point, the gear 42 is in the energized position due to the bias of the spring 86 (shown in FIG. 2) but, because the timing member 32 is simultaneously activated, the arm 38 and notched rack 88 are moved to the retracted position and the notched rack 88 engages the portion 90 of the gear 42, as shown in FIG. 9. Consequently, the gear 42 does not rotate back to the rest position but is retained in the energized position by the notched rack 88.

Figure 12B:
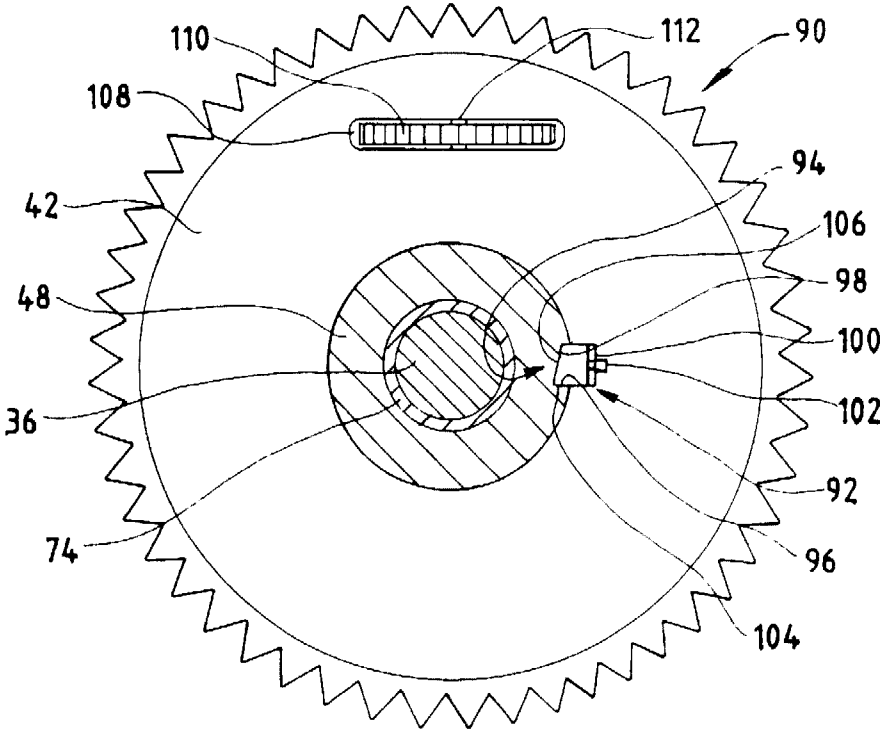
FIG. 12B is the same view as FIG. 12B and illustrates the relative position of the gear and the cylindrical member after the shaft has rotated toward the de-activated position.
Figure 12A:
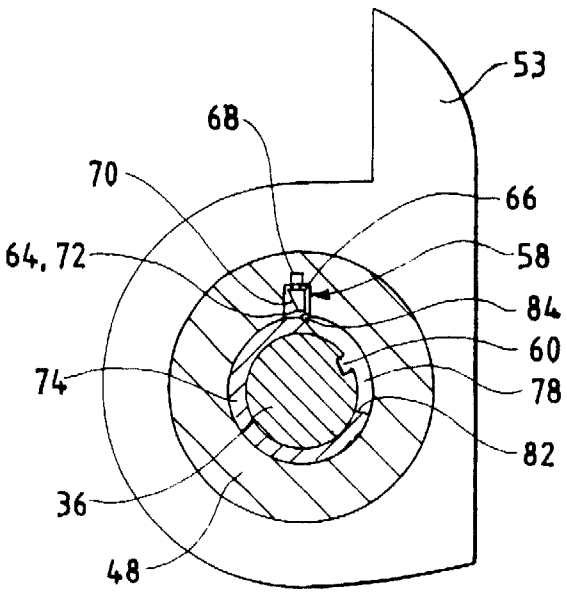
FIG. 12A is the same view as FIG. 11A and illustrates the relative positions of the shaft and the cylindrical member after the shaft has rotated toward the de-activated position.

FIGS. 12A and 12B indicate the relative positions of the shaft 36, the cylindrical member 48, and the gear 42 during the pre-determined time interval. Rotating the cylindrical member 48 along curve A to the positions shown in FIGS. 11A and 11B rotates the shaft 36 to the activated position and activates the timing member 32. Once the timing member 32 is activated, due to the operative coupling of the shaft 36 to the timer gears 34 the shaft 36 automatically rotates back towards the de-activated position, as seen in FIG. 12A. However, the cylindrical member 48 does not rotate with the shaft 36 because the locking pin 58 of the cylindrical member 48 and the aperture 60 in the shaft 36 are uncoupled. Consequently, the cylindrical member 48 remains in the position corresponding to the open position of the cover 132 (shown in FIG. 15). In addition, as shown in FIG. 12B the gear 42 does not rotate with the shaft 36 and remains in the energized position due to the engagement between the portion 90 of the gear 42 and the notched rack 88. Thus neither the hinge assembly 44 nor the gear 42 rotates with the shaft 36 as the shaft 36 automatically returns to the de-activated position during the pre-determined time interval. At the completion of the pre-determined time interval the shaft 36 rotates completely back to the de-activated position and the arm 38 and notched rack 88 move from the retracted position, shown in FIG. 9, to the extended position, shown in FIG. 8, thereby releasing the gear 42. Because of the bias of the spring 86 (shown in FIG. 2) the gear 42 then rotates along curve B, back to the rest position. As the gear 42 rotates along curve B, the locking surface 96 of the finger 92 on the gear 42 engages the first surface 104 of the dimple 94 in the cylindrical member 48 and causes the cylindrical member 48 to rotate in the second direction, along curve B. Consequently, the cover 132 is moved to the closed position (shown in FIG. 16) as the gear 42 and the cylindrical member 48 rotate along curve B. The cover 132 thus remains in the open position during the pre-determined time interval and is moved automatically to the closed position at the completion of the pre-determined time interval by the interaction of the gear 42 and the cylindrical member 48.

Figure 13B:
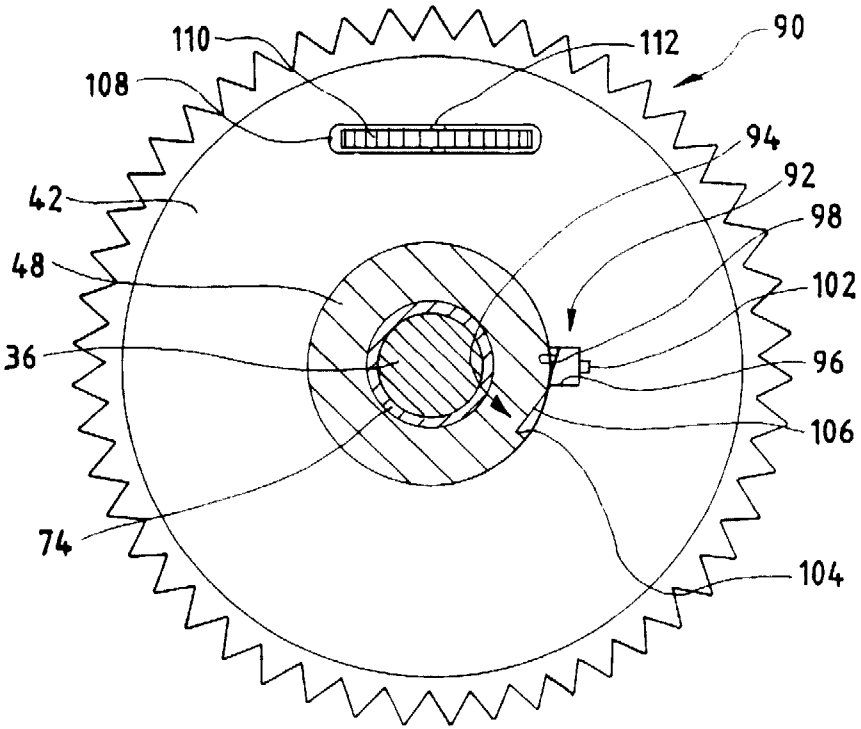
FIG. 13B is the same view as FIG. 11B and illustrates the relative position of the gear and the cylindrical member after the cylindrical member has been manually rotated in the second direction.
Figure 13A:
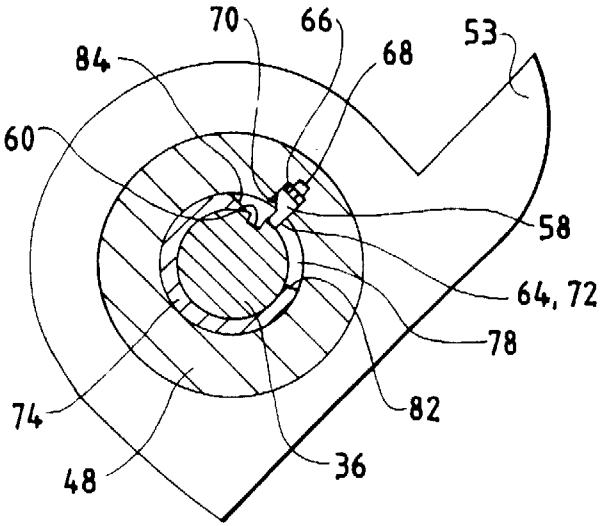
FIG. 13A is the same view as FIG. 11A and illustrates the relative position of the shaft and the cylindrical member after the cylindrical member has been manually rotated in a second direction opposite to the first rotational direction.

As noted previously, in the preferred embodiment the finger 92 is retractably mounted in the cavity 100 by the spring 102 so that gear 42 is reversibly coupled to the cylindrical member 48. In this case, the cylindrical member 48 can be rotated in the second direction, along curve B, independent of the gear 42. This would occur, for example, when the cover 132 (shown in FIGS. 15 and 16) is manually moved to the closed position after the timing member 32 has been activated. FIGS. 13A and 13B illustrate the relative concurrent positions of the shaft 36, the cylindrical member 48, and the gear 42 when the cylindrical member 48 is rotated from the position shown in FIGS. 11A and 11B along curve B, concurrently with the manual closing of the cover 132. As shown in FIG. 11A, when the cylindrical member 48 is in a position that corresponds to the open position of the cover 132, the locking pin 58 and the aperture 60 are uncoupled and the aperture 60 is initially at least partially covered by the sleeve 74. At this point if the cover 132 is manually moved towards the closed position, the hinge assembly 44, including the cylindrical member 48, is rotated along curve B. As the cylindrical member is rotated along curve B, the locking pin 58 moves past the sleeve 74 and the aperture 70 and the spring 68 urges the locking pin 58 outward from the cavity 100 toward the notch 78, as shown in FIG. 13A. Consequently, the shaft 36 remains uncoupled from the cylindrical member 48 and continues to rotate independently toward the de-activated position. In addition, as the cylindrical member 48 is rotated along curve B the second surface 106 of the dimple 94 engages the camming surface 98 of the finger 92 which, because of the spring 102, is moved into the retracted position, as shown in FIG. 13B. The gear 42 thus becomes disconnected from the cylindrical member 48 when the cylindrical member 48 is rotated along curve B concurrent with the manual movement of the cover 132 toward the closed position. Consequently, the gear 42 remains in the energized position until the completion of the pre-determined time interval and then rotates back to the rest position after the arm 38 and notched rack 88 move to the extended position at the completion of the pre-determined time interval. A reversible connection between the gear 42 and the cylindrical member 48 thus facilitates manual closing of the cover 132 before the completion of the pre-determined time interval.

When the cover 132 (shown in FIGS. 15 and 16) is not manually lowered, the gear 42 and the cylindrical member 48 remain coupled throughout the pre-determined time interval. Consequently, the cover 132 is moved automatically to the closed position when the bias of the spring 86 urges the gear 42 to the rest position at the completion of the pre-determined time interval. In some cases the force of gravity acting on the cover 132 can cause the cover 132 to close too rapidly. Such would occur, for example, if the cover 132 is relatively massive, as is a toilet seat. The device 30 therefore can include control elements which cooperate with the gear 42 to ensure that the gear 42 rotates to the rest position in a controlled fashion that is not unduly influenced by the mass of the cover 132. Returning to FIGS. 1 and 2, the control elements include a slot 108 that is formed in the gear 42 and that is positioned in the gear 42 so that the slot 108 traces an arcuate path D when the gear 42 rotates along curve A and B. A pinion 110 is rotatably mounted within the slot 108 by a pin 112. The pinion 110 thus also moves in the arcuate path D when the gear 42 rotates along curves A and B. The control elements also include an arcuate notched guide 114 that is formed on a surface 116 of the plate member 40, as shown in FIG. 1. The notched guide 114 is positioned and shaped to engage the pinion 110 when the pinion 110 moves in the arcuate path D. Consequently, when the gear 42 rotates along curve B from the energized position to the rest position the arcuate notched guide 114 engages the pinion 110 thereby controlling the rotation of the gear 42. The device 30 can include additional control elements if the cover 132 is excessively massive. For example, the device 30 can include a flange 118 that is secured to the cylindrical member 48 near the portion 56 of the cylindrical member 48 that is encircled by the gear 42 and so is approximately adjacent the gear 42. A second arcuate notched guide 120 is formed on a surface 119 of the flange 118, as shown in FIG. 2. Like the first notched guide 114, the second notched guide 120 is positioned and shaped to engage the pinion 110 when the pinion 110 moves in the arcuate path D. Consequently, when the gear 42 rotates along curve B from the energized position to the rest position both arcuate notched guides 114 and 120 engage the pinion 110 thereby controlling the rotation of the gear 42.

Figure 14:
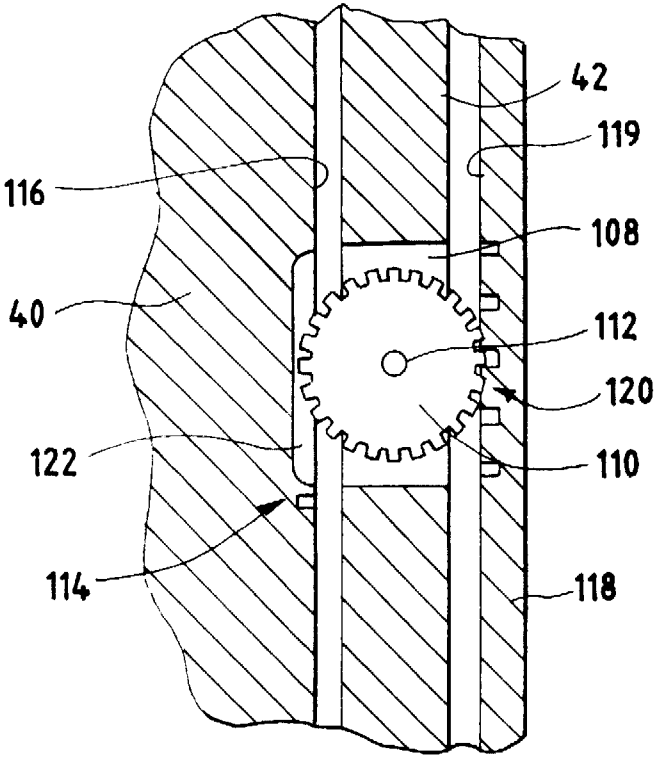
FIG. 14 is a cross-sectional view a long line 14—14 in FIG. 9.

The device 30 can further include a slot 122, shown in FIG. 1, that is formed on the surface 116 of the plate member 40 in a position where the slot 122 engages the pinion 110 when the gear 42 is in the energized position. The slot 122 facilitates manual movement of the cover 132 (shown in FIGS. 15 and 16) to the closed position. When the gear 42 rotates along curve A from the rest position to the energized position, the pinion 110 is engaged by the arcuate notched guides 114 and 120. When the gear 42 is in the energized position, the pinion 110 is engaged by the slot 122 in the plate member 40 and by the arcuate notched guide 120 on the flange 118, as shown in FIG. 14. If the cover 132 is manually moved to the closed position, the flange 118 and the arcuate notched guide 120 rotate concurrently with the cylindrical member 48 along curve B. As the flange 118 and arcuate notched guide 120 rotate along curve B, the arcuate notched guide 120 on the flange 118 engages the pinion 110. However, the pinion 110 is also engaged by the slot 122 in the plate member 40. Consequently, when the cover 132 is manually moved toward the closed position the engagement of the pinion 110 by the slot 122 in the plate member 40 and the arcuate notched guide 120 on the flange 118 merely causes the pinion 110 to rotate within the slot 108 in the gear 42 and within the slot 122 in the plate member 40. The cover 132 can thus be manually lowered without disarming the timing member 32.

Figure 15:
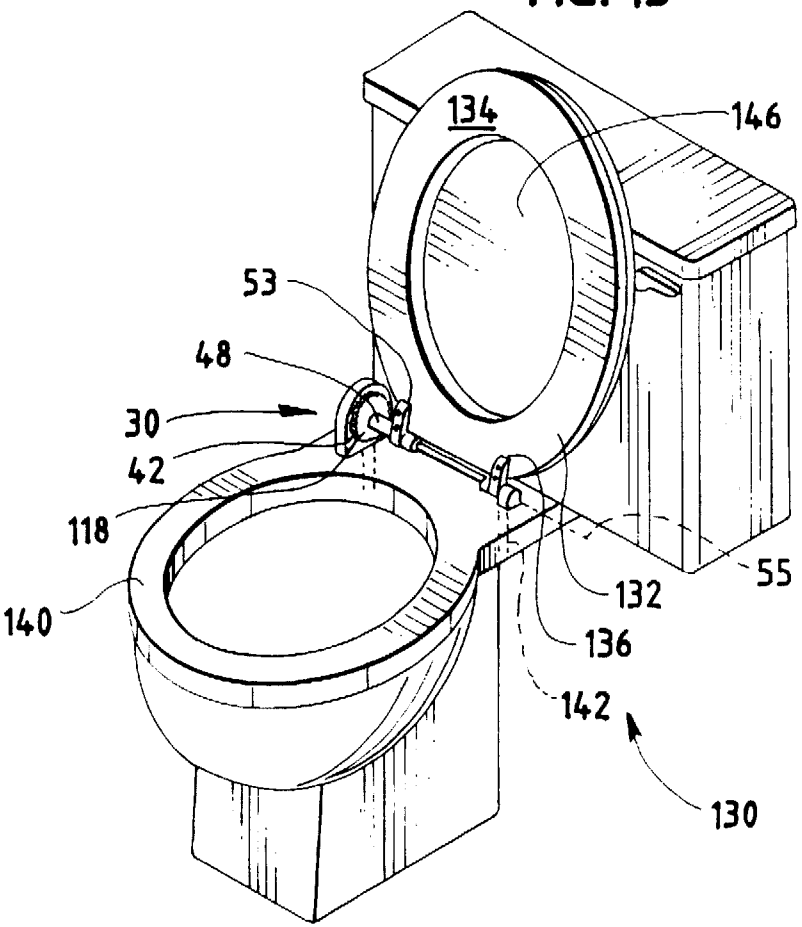
FIG. 15 is a front-perspective view of the device in FIGS. 1, 2, 8, and 9 attached to the seat of a conventional toilet with the seat raised to the open position.
Figure 17:
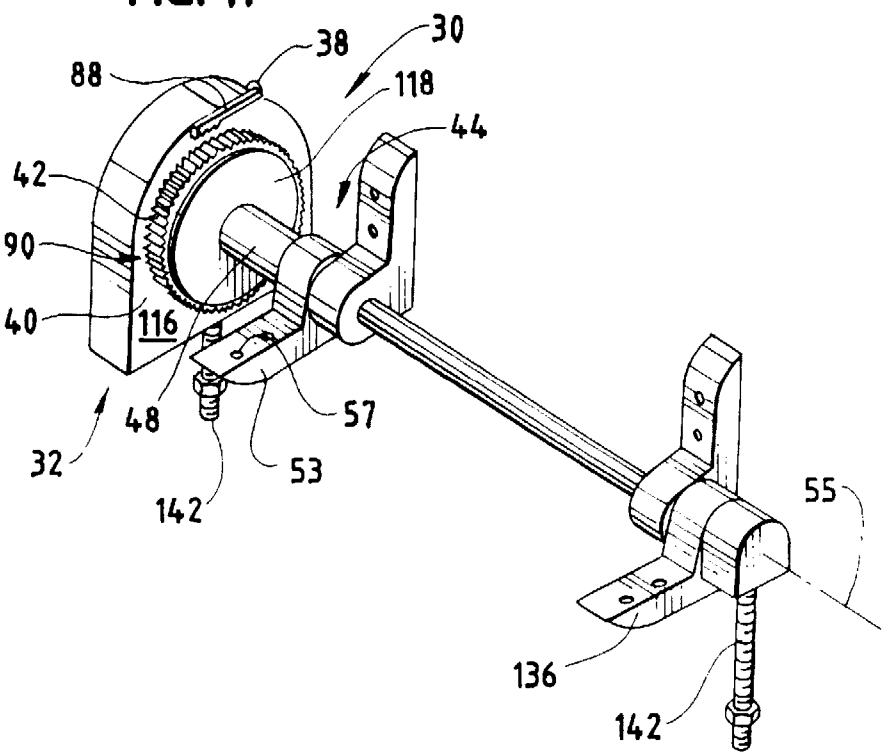
FIG. 17 is a front perspective view of the device in FIGS. 1, 2, 8, and 9 attached to a conventional replacement seat and lid hinge for a conventional toilet.
Figure 16:
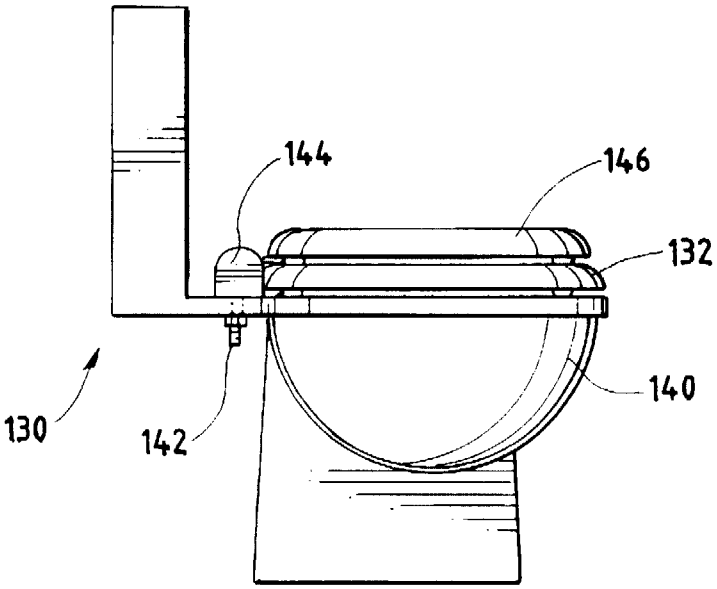
FIG. 16 is a side plan view of the device and toilet in FIG. 15 with the seat lowered to the closed position.

FIGS. 15–17 illustrate the use of the device 30 with a conventional toilet 130. The device 30 is mounted on the toilet bowl 140 so that the device 30 is aligned with the normal pivot axis 55 of the toilet seat hinges 136 and with the bolt holes 138 used to connect the hinges 136 to the toilet bowl 140. The device 30 is securely fastened to the toilet bowl 140 and preferably is fastened to the toilet bowl 140 by the bolts 142 used to fasten a conventional seat hinge 136 to the toilet bowl 140. In the preferred embodiment, the device 30 is contained within a housing 144 to which a conventional bolt 142 is secured such that the device 30 is bolted to the toilet bowl 140, as shown in FIG. 16. Alternatively, a bolt 142 can be directly secured to body of the timing member 32, as shown in FIG. 17.

Figure 18:
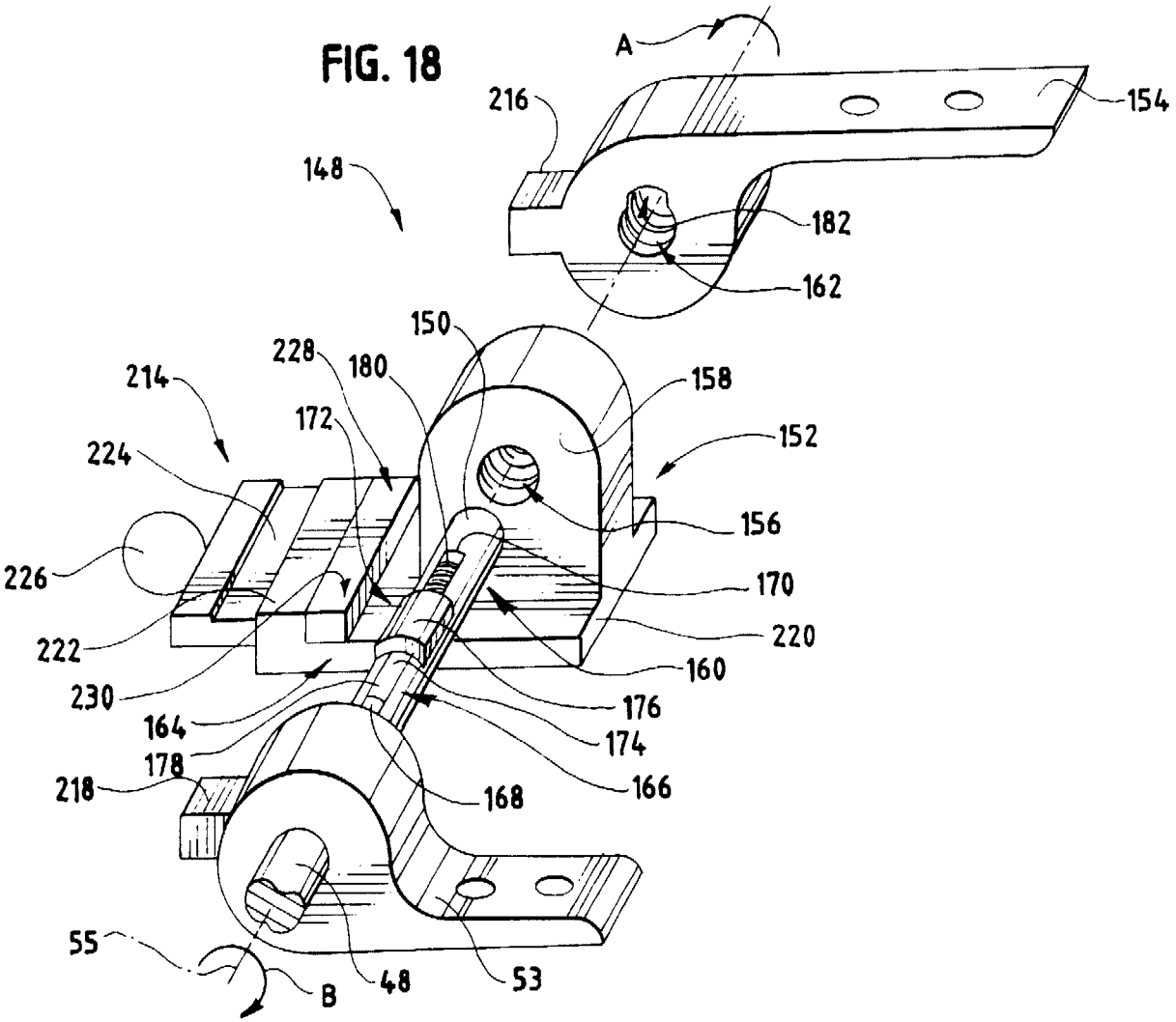
FIG. 18 is an exploded side perspective view of a second hinge assembly, a seat hinge to lid hinge coupler, and an anti-rotation mechanism which can form parts of the device shown in FIG. 1.
Figure 22:
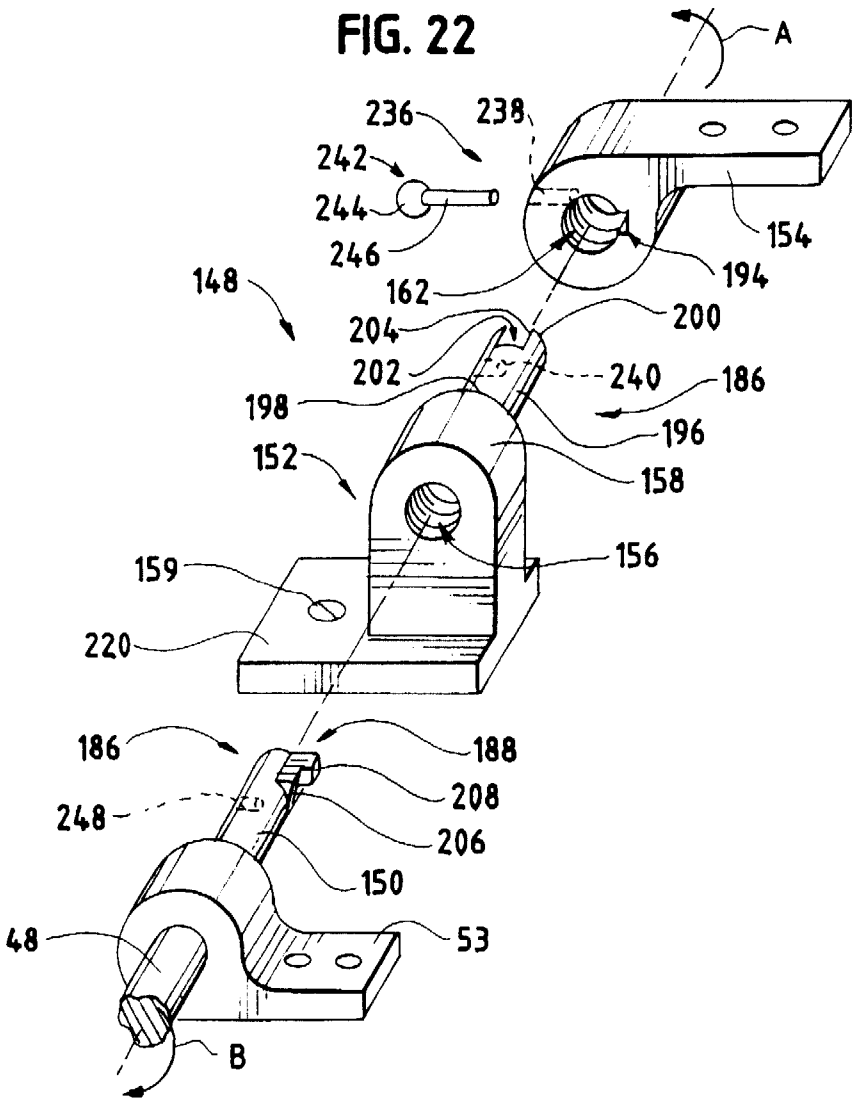
FIG. 22 is an exploded side perspective view of the second hinge assembly in FIG. 18 and shows an alternative embodiment of the seat hinge to lid hinge coupler and an alternative embodiment of the anti-rotation mechanism.

In the preferred embodiment, the device 30 further includes a second hinge assembly 148 that performs two additional functions. The second hinge assembly 148 couples the toilet lid 146 to the device 30 so that the lid 146 is automatically lowered when the toilet seat 132 is automatically lowered; and the second hinge assembly 148 permits the lid 146 and the toilet seat 132 to be locked in the closed position. FIGS. 18 and 22 show one embodiment of the second hinge assembly 148 which includes a pivot rod 150, an anchor 152, and a lid hinge 154. Unlike conventional toilet hinge assemblies, the pivot rod 150 of the second hinge assembly 148 is secured to the seat hinge 53, opposite the cylindrical member 48, so that the pivot rod 150 rotates concurrently with the seat hinge 53. Consequently, the pivot rod 150 rotates in the first direction (along curve A) when the seat hinge 53 and the cylindrical member 48 rotate in the first direction and the pivot rod 150 rotates in the second direction (along curve B) when the seat hinge 53 and the cylindrical member 48 rotate in the second direction. The pivot rod 150 extends through a bore 156 that is formed in the body portion 158 of the anchor 152 and that is sized and shaped to accommodate the pivot rod 150. The anchor 152 is secured to the toilet bowl 140 by conventional devices, for example, by a bolt 159 or by adhesives. The pivot rod 150 thus rotates within the bore 156 in the first and second directions. A portion 160 of the pivot rod 150 is also positioned within a duct 162 that is formed in the lid hinge 154 and is sized and shaped to receive the portion 160. The lid hinge 154 is thus rotatably coupled to the pivot rod 150 is and rotatable between a closed configuration, shown in FIG. 16, and an open configuration, shown in FIG. 15.

Figure 19:
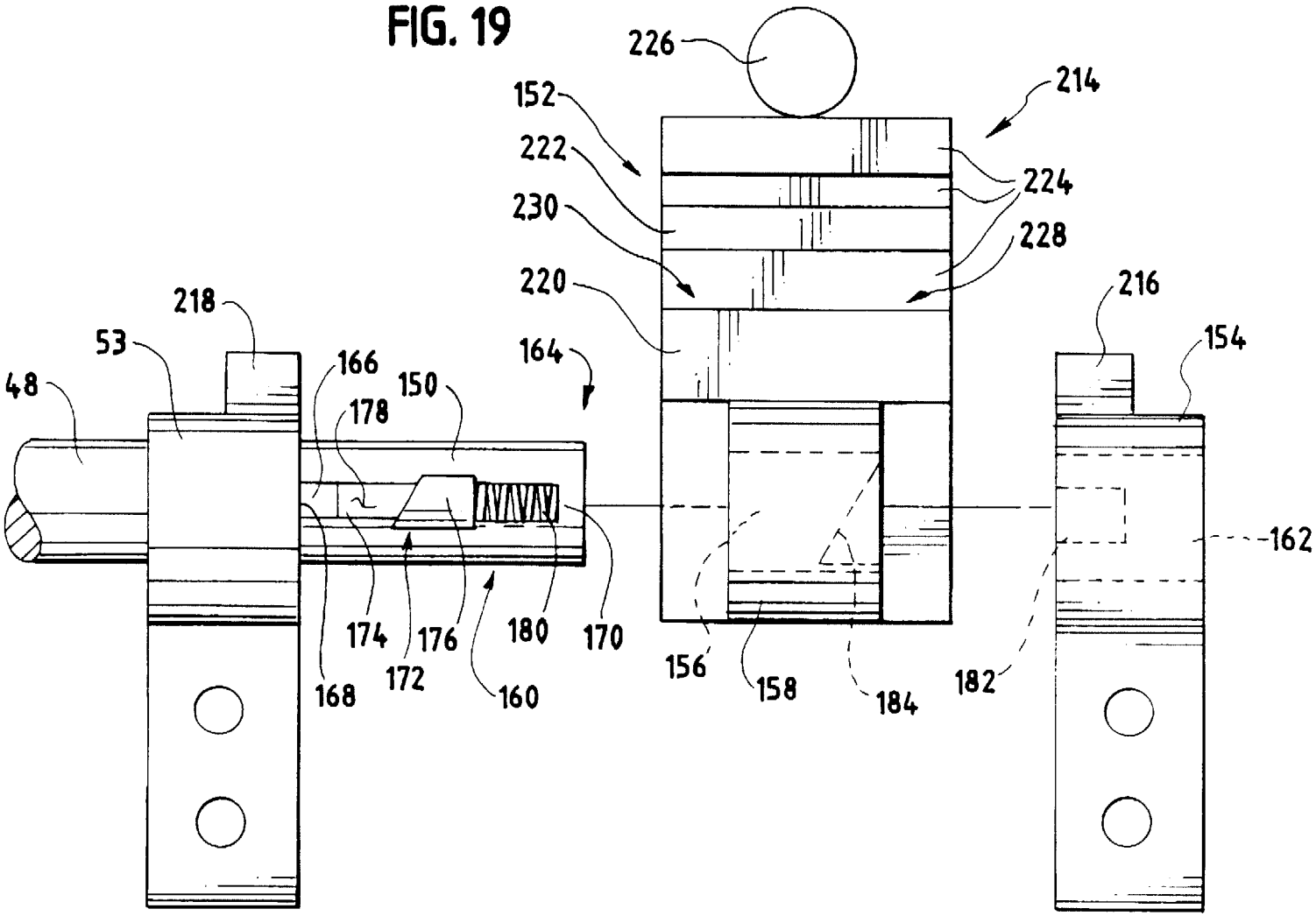
FIG. 19 is an exploded top plan view of the second hinge assembly, the seat hinge to lid hinge coupler, and the anti-rotation mechanism in FIG. 18.
Figure 20:
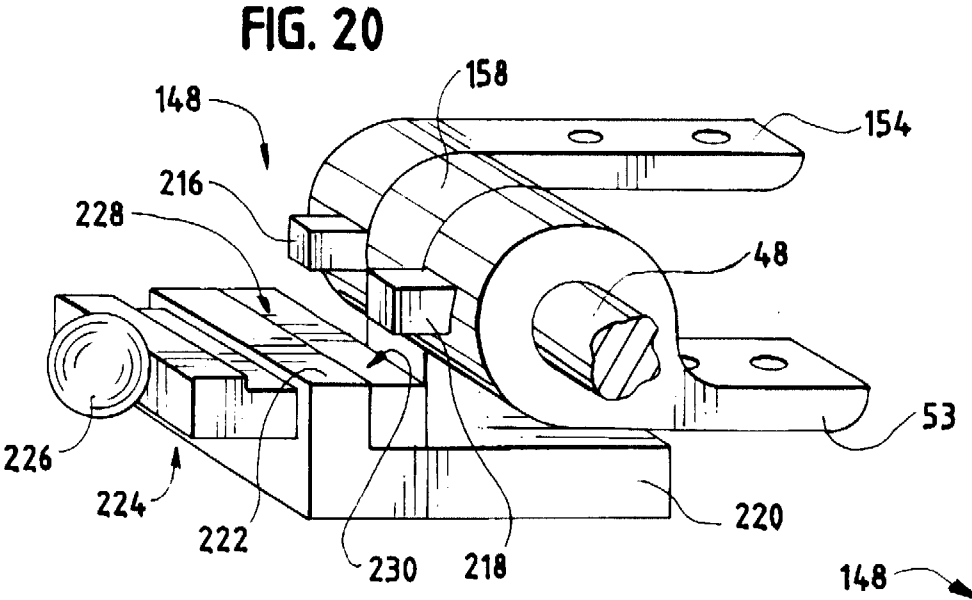
FIG. 20 is a side perspective view of the second hinge assembly, the seat hinge to lid hinge coupler, and the anti-rotation mechanism in FIG. 18 and illustrates the relative positions of the seat hinge, lid hinge and anti-rotation mechanism when the anti-rotation mechanism is in an un-locked configuration.
Figure 21:
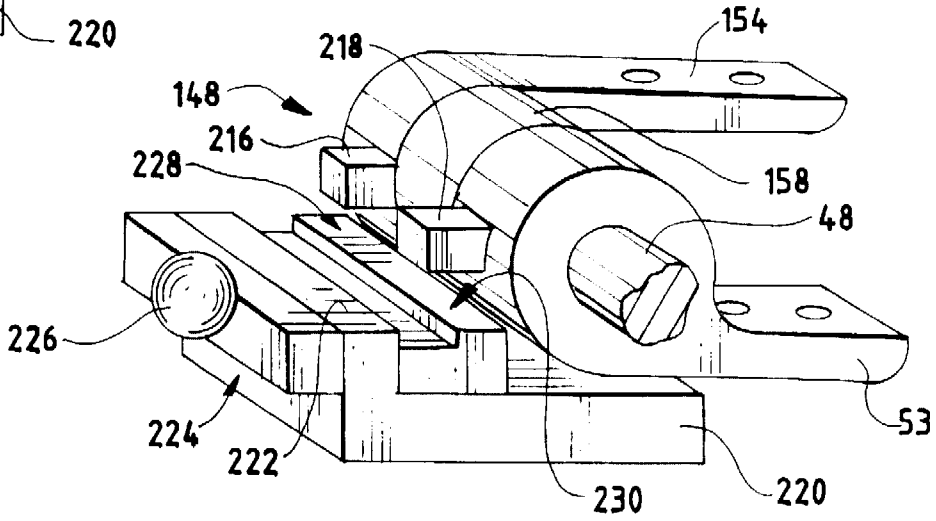
FIG. 21 is a side perspective view of the second hinge assembly, the seat hinge to lid hinge coupler, and the anti-rotation mechanism in FIG. 18 and illustrates the relative positions of the seat hinge, the lid hinge and anti-rotation mechanism when the anti-rotation mechanism is in a locked configuration.

Because the pivot rod 150 is secured to the seat hinge 53, the device 30 can also be used to couple the toilet lid 146 to the cylindrical member 48 via the seat hinge 53 so that the lid 146 is automatically lowered when the toilet seat 132 is automatically lowered. In the preferred embodiment the second hinge assembly 148 thus also includes a coupling device which couples the lid hinge 154 to the first hinge assembly 44. FIGS. 18–19 show one embodiment 164 of the coupling device which includes an elongated track 166 that is formed in the pivot rod 150 and is positioned along the pivot rod 150 so that the second end 170 of the track 166 is located at least partially along the portion 160 of the pivot rod 150 which is positioned in the duct 162. A latch 172 is positioned within the track 166 and includes two portions 174 and 176. The first portion 174 has an outer surface 178 shaped to conform with the curvature of the pivot rod 150. The second portion 176 is attached to the first portion 174 intermediate the first portion 174 and the second end 170 of the track 166 and extends outwardly from the track 166. A spring 180 is also positioned within the track 166 intermediate the latch 172 and the second end 170 of the track 166. The spring 180 biases the latch 172 towards the first end 168 of the track 166. A latch guide 182 is formed in the lid hinge 154 and is positioned to intersect the duct 162. The latch guide 182 is shaped to accommodate the second portion 176 of the latch 172. The coupling device 164 further includes a camming surface 184 (best seen in FIG. 19) that is formed along the bore 156 of the anchor 152 and is positioned and shaped to engage the second portion 176 of the latch 172.

When the seat 132 and the lid 146 are both closed, as shown in FIG. 16, the second portion 176 of the latch 172 is retracted from the latch guide 182 due to both the shape of the camming surface 184 and the bias of the spring 180. As the seat 132 and the lid 136 are raised to the open position shown in FIG. 15, the pivot rod 150 rotates in the first direction, along curve A, due to its attachment to the seat hinge 53. As the pivot rod 150 rotates in the first direction, the camming surface 184 engages the second portion 176 of the latch 172 and thereby urges the latch 172 towards the second end 170 of the track 166. The second portion 176 is thus urged into engagement with the latch guide 182 which couples the lid hinge 154 to the seat hinge 53 and to the cylindrical member 48. Thus, when the seat 132 and the lid 146 are in the open position shown in FIG. 15 the second portion 176 is positioned within the latch guide 182. Consequently, when the seat 132 is initially lowered, for example at the completion of the pre-determined time interval, the lid 146 also moves towards the closed position because the lid hinge 154 is coupled to the seat hinge 53. As the seat 132 is lowered toward the closed position, the seat hinge 53 and hence the pivot rod 150 rotate in the second direction, along curve B. As this occurs, the spring 180 urges the latch 182 towards the first end 168 of the track 166 and the second portion 170 moves back along the camming surface 184 and is retracted from the latch guide 182 so that the lid hinge 154 is uncoupled from the seat hinge 53 and the cylindrical member 48. The lid hinge 154, and hence the lid 146, thus become uncoupled from the seat hinge 53 and the cylindrical member 48 at a position between the open position and the closed position. The lid 154, however, continues to move towards the closed position due to the force of gravity. The coupling device 164 thus couples the lid hinge 154 and hence the lid 146 to the seat hinge 53 and the cylindrical member 48 so that the lid hinge 154 rotates towards the closed configuration when the cylindrical member 48 rotates in the second direction. In addition, the lid hinge 154 is uncoupled from the seat hinge 53 and the cylindrical member 48 when the lid hinge 154 is in the closed configuration. Consequently, the lid 146 and the lid hinge 154 can be rotated independently of the seat hinge 53 so that the lid 146 can be opened while the seat 132 remains in the closed position.

FIGS. 22–18 show a second embodiment 186 of a coupling device which couples the toilet lid 146 to the cylindrical member 48 via the seat hinge 53 so that the lid 146 is automatically lowered when the toilet seat 132 is automatically lowered. The coupling device 186 includes a lock member 188 that is located in a depression 190 which is formed along the portion 160 of the pivot rod 150 that is positioned within the duct 162. The lock member 188 is fastened to the pivot rod 150 by a spring 192 and so may be retracted into the depression 190. The lock member 188 includes a camming surface 206 and an extended portion 208 which is sized and shaped to fit within a recess 194 that is formed along the duct 162 of the lid hinge 154. The lock member 188 is positioned along the pivot rod 150 so that the extended portion 208 of the lock member 188 can engage the recess 194 when the seat 132 and the lid hinge 154 are in the open position, shown in FIG. 15. The lock member 188 thus couples the lid hinge 154 to the seat hinge 53 and the cylindrical member 48 when both the seat 132 and the lid 146 are open. The coupling device 186 also includes a tubular member 196 that retracts the lock member 188 into the depression 190 as the pivot rod 150 rotates in the second direction. The tubular member 196 is sized to receive the pivot rod 150 and is secured at one end 198 to the body portion 158 anchor member 152 to encircle the pivot rod 150. The tubular member 196 includes a cut-out guide 202 that is positioned along the other end 200 of the tubular member 196. The cut-out guide 202 defines an unlocking surface 204 which is shaped to engage the camming surface 206 of the lock member 188 to retract the lock member 188 into the depression 190 and thereby remove the extended portion 208 from the recess 194 and uncouple the lid hinge 154 from the seat hinge 53.

Figure 24:
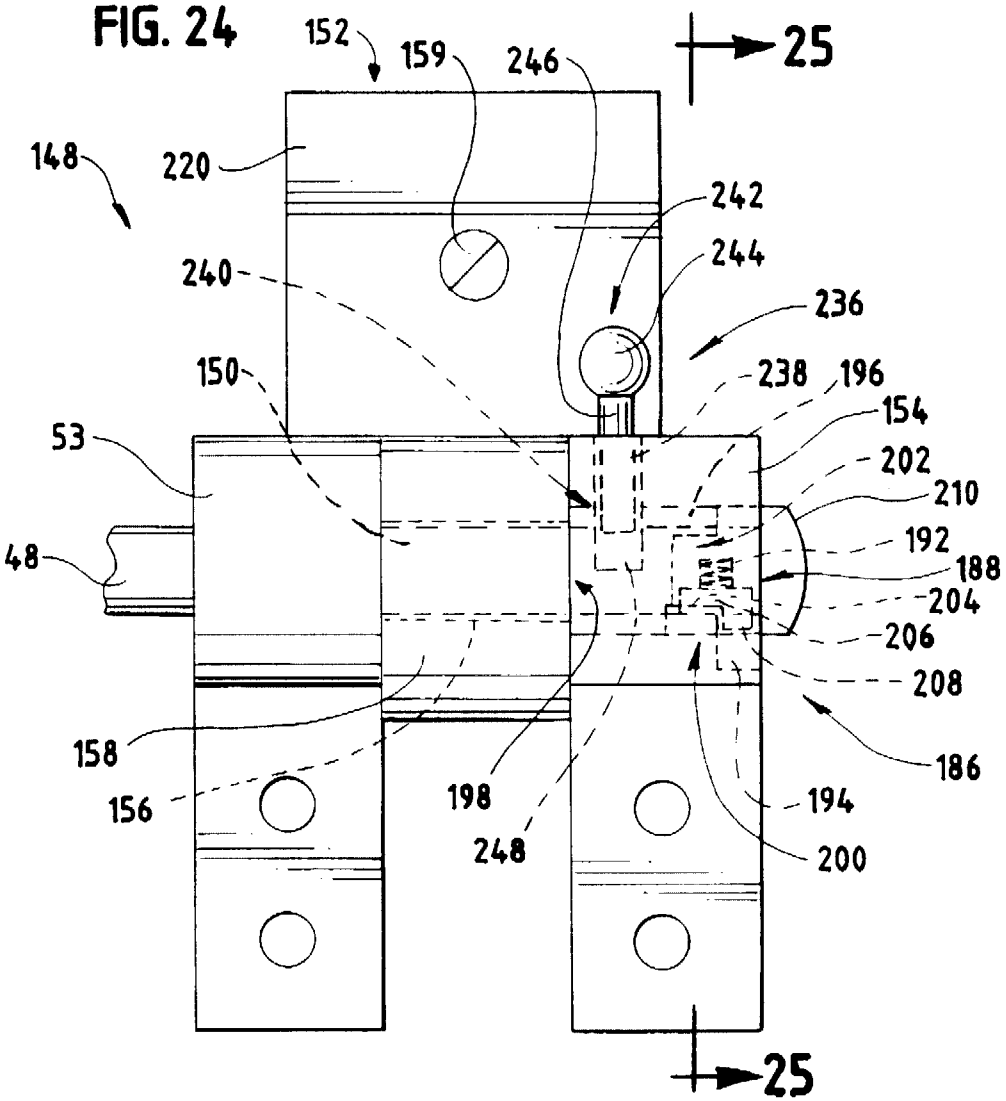
FIG. 24 is an assembled top plan view of the second hinge assembly, the seat hinge to lid hinge coupler, and the anti-rotation mechanism in FIG. 23.
Figure 26:
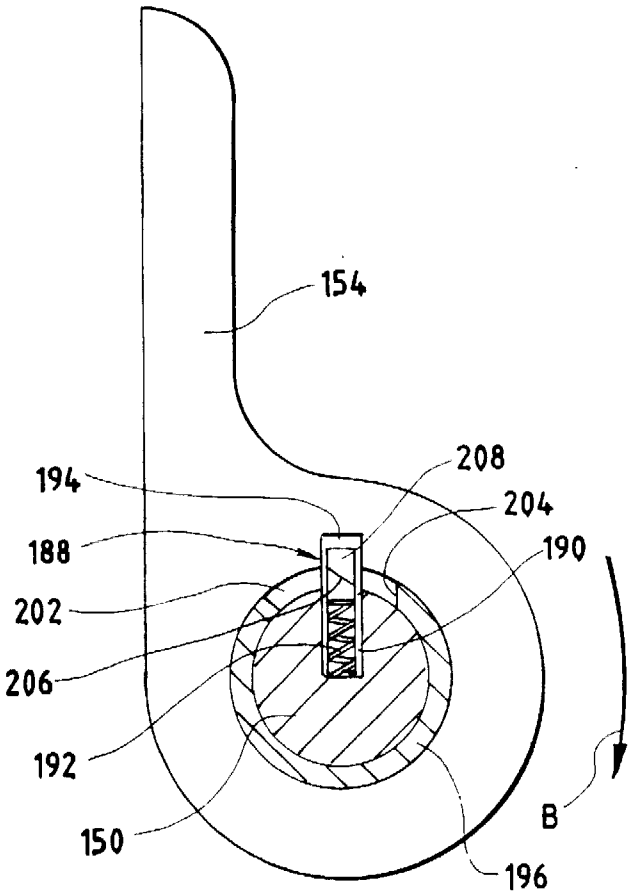
FIG. 26 is the same view as FIG. 25 and illustrates the relative positions of the components of the seat hinge to lid hinge coupler when the seat and the lid are in the open configuration.
Figure 25:
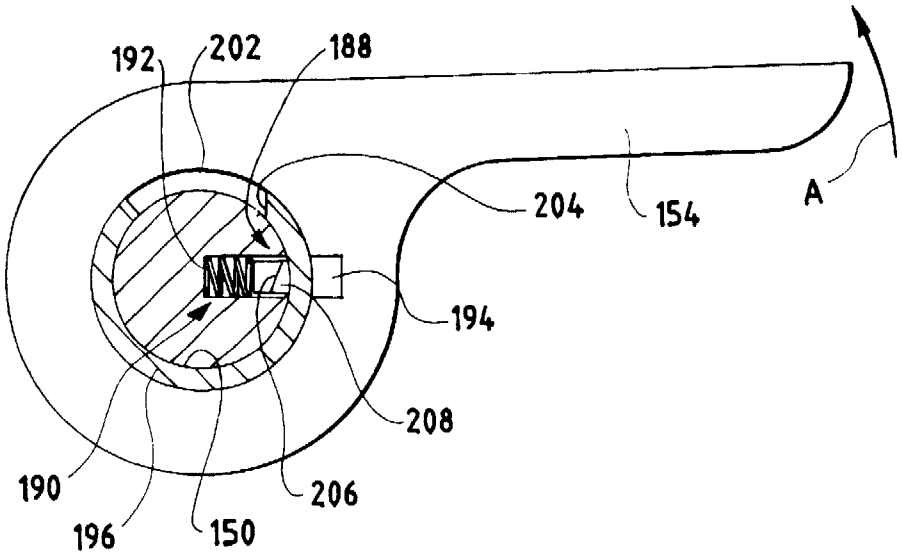
FIG. 25 is a cross sectional view along line 25—25 in FIG. 24 and illustrates the relative positions of the components of the seat hinge to lid hinge coupler when the seat and lid are in the closed position.
Figure 28:
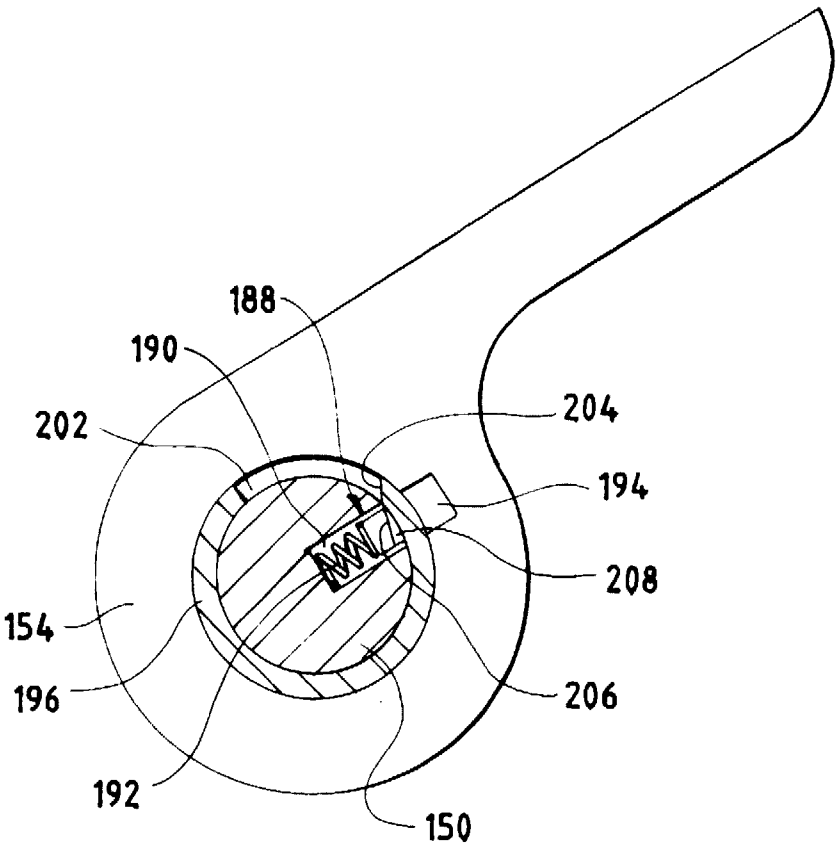
FIG. 28 is the same view as FIG. 25 and illustrates the relative positions of the components of the seat hinge to lid hinge coupler after the seat and the lid have rotated further toward the closed position.
Figure 27:
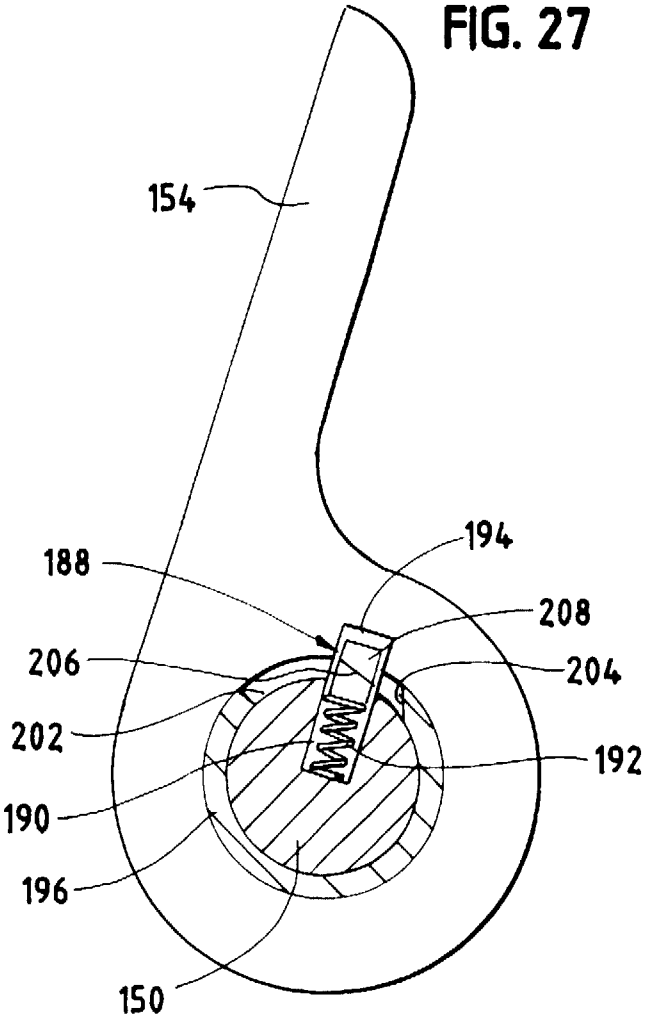
FIG. 27 is the same view as FIG. 25 and illustrates the relative positions of the components of the seat hinge to lid hinge coupler after the seat and the lid have initially rotated toward the closed position.

The tubular member 196 can be either non-movably attached or rotatably attached to the body portion 158 of the anchor member 152. When the tubular member 196 is non-movably attached to the body portion 158, the tubular member 196 and the cut-out guide 202 are positioned to locate the lock member 188 within the cut-out guide 202 and the extended portion 208 within the recess 194 when the seat 132 and the lid hinge 154 are in the open position. In addition, the tubular member 196 and the cut-out guide 202 are positioned so that the lock member 188 is retracted into the depression 190 and the extended portion 208 is removed from the recess 194 when the lid hinge 154 and the lid 146 are in the closed position, as shown in FIGS. 24 and 25. When the seat hinge 53, the pivot rod 150, and the lid hinge 154 rotate in the first direction from the closed positioned to the open position, the lock member 188 rotates in first direction and moves into the cut-out guide 202. In addition, when the seat 132 moves toward the open position, the lid 146 and the lid hinge 154 also rotate in the first direction so that the recess 194 is aligned with the extended portion 208. Once within the cut-out guide 202, the lock member 188 extends from the depression 190 and the extended portion 208 engages the recess 194 and couples the lid hinge 154 to the seat hinge 53 and hence to the cylindrical member 48, as shown in FIG. 26. Consequently, when the seat 132 is initially lowered, for example at the completion of the pre-determined time interval, the lid 146 also moves towards the closed position because the lid hinge 154 is coupled to the cylindrical member 48 via the seat hinge 53. As the seat 132 is lowered toward the closed position, the seat hinge 53, the pivot rod 150, and the lid hinge 154 rotate in the second direction, along curve B. As this occurs, the lock member 188 and the recess 194 rotate in the second direction and move toward the unlocking surface 204 of the cut-out guide 202 as shown in FIG. 27. When the lock member 188 contacts the un-locking surface 204, the unlocking surface 204 engages the camming surface 206 of the lock member 188 and retracts the lock member 188 into the depression 190 and removes the extended portion 208 from the recess 194 thereby uncoupling the lid hinge 154 from the seat hinge 53 and the cylindrical member 48, as shown in FIG. 28. The lid hinge 154, and hence the lid 146, thus become uncoupled from the seat hinge 53 and the cylindrical member 48 at a position between the open position and the closed position. The lid 154, however, continues to move towards the closed position due to the force of gravity. The coupling device 186 thus couples the lid hinge 154 and hence the lid 146 to the seat hinge 53 and the cylindrical member 48 so that the lid hinge 154 rotates towards the closed configuration when the cylindrical member 48 rotates in the second direction. In addition, the lid hinge 154 is uncoupled from the seat hinge 53 and the cylindrical member 48 when the lid hinge 154 is in the closed configuration. Consequently, the lid 146 and the lid hinge 154 can be rotated independently of the seat hinge 53 so that the lid 146 can be opened while the seat 132 remains in the closed position.

Figure 30:
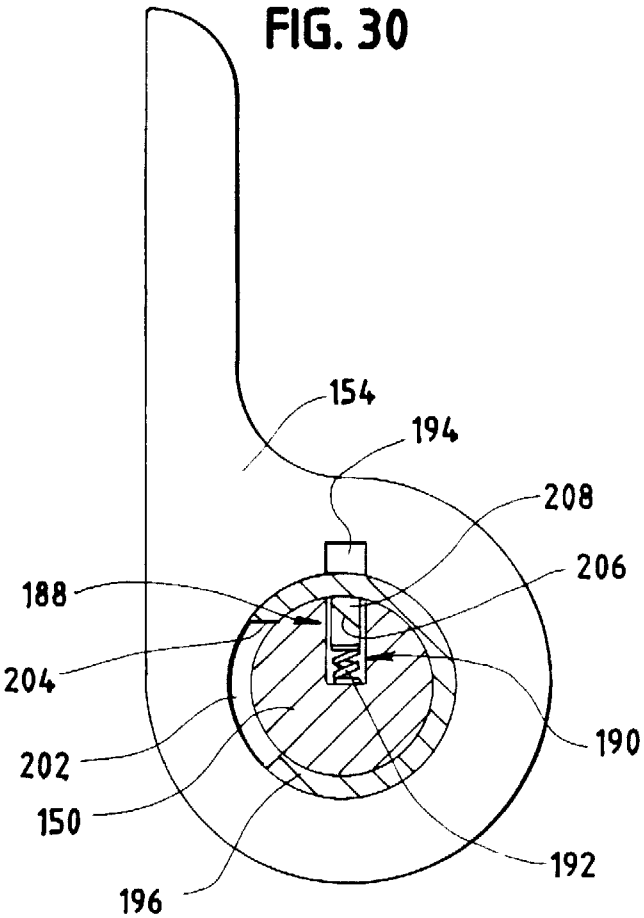
FIG. 30 is the same view as FIG. 26 and illustrates the relative positions of the components of the seat hinge to lid hinge coupler after the tubular member has been rotated to the second position and the seat and the lid are in the open position.
Figure 29:
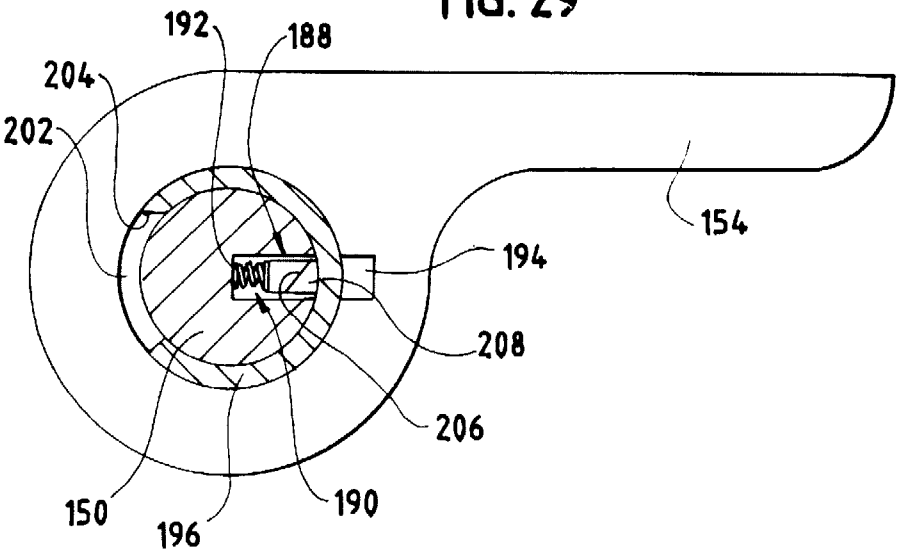
FIG. 29 is the same view as FIG. 25 and shows relative positions of the components of the seat hinge to lid hinge coupler after the tubular member has been rotated to the second position and the seat and the lid are in the closed position.

When the tubular member 196 is rotatably coupled to the body portion 158, the coupling device 186 further includes a finger piece 210 that is used to rotate the tubular member 196 between a first position, shown in FIGS. 22–28, and a second position, shown in FIGS. 29 and 30. The finger piece 210 is secured to the end 200 of the tubular member 196 and extends outwardly from the lid hinge 154, as best seen in FIG. 24. When the tubular member 196 is in the first position, the cut-out guide 202 is positioned so that the lock member 188 is retracted into the depression 190 and the extended portion 208 is removed from the recess 194 when the lid hinge 154 and the lid 146 are in the closed position, as shown in FIGS. 24 and 25. In addition, when the tubular member 196 is in the first position and the seat 132 and the lid 146 are in the open position (shown in FIG. 15), the lock member 188 is positioned within the cut-out guide 202 so that the extended portion 208 engages the recess 194, as shown in FIG. 26. Consequently, when the tubular member 196 is in the first position the coupling device 186 behaves in the manner previously described with reference to FIGS. 24–28 and thus reversibly couples the lid hinge 154 to the seat hinge 53 so that lid hinge 154 rotates towards the closed configuration when the seat hinge 53 and the cylindrical member 48 initially rotate in the second direction. When the tubular member 196 is in the second position, however, the lid hinge 154 remains uncoupled from the seat hinge 53 so that the lid 146 remains open when the seat 132 is moved to the closed configuration. The tubular member 196 is moved to the second position by rotating the tubular member 196, via the finger piece 210, either clockwise or counterclockwise through an arc that is sufficient to move the cut-out guide 202 out of alignment with the recess 194 and the extended portion 208 when the lid 146 and the seat 132 are in the open position. In the preferred embodiment, the tubular member 196 is moved to the second position by rotating the tubular member 196 in a direction that corresponds with curve A, as shown in FIGS. 29 and 30. This preferred rotational direction helps to ensure that the lid hinge 154 remains uncoupled from the seat hinge 53 when the seat 132 and the lid 146 are moved to the open position. In addition, in the preferred embodiment the tubular member 196 is rotated through an arc of about 90 degrees to move the tubular member 196 to the second position. The exact size of the arc can vary, however, depending on the relative sizes of the cut-out guide 202 and the lock member 188. When the tubular member 196 is in the second position and the lid hinge 154, the seat hinge 53, and the pivot rod 150 are in a configuration that corresponds to the closed position of the seat 132 and the lid 146, the lock member 188 is retracted into the depression 190 and the extended portion 208 is removed from the recess 194, as shown in FIG. 29. Thus, when both the seat 132 and the lid 146 are closed, the lid 146 can be rotated independently of the seat 132 so that the lid 146 can be opened while the seat 132 remains closed. When the seat 132 and the lid 146 are moved to the open position, the seat hinge 53 and the pivot rod 150 move in the first direction, along curve A, and the lid hinge 154 moves to the open configuration, thereby moving the depression 190, the lock member 188, and the recess 194 into the relative positions shown in FIG. 30. Because the tubular member 196 and the cut-out guide 202 are in the second position, the lock member 188 remains outside of the cut-out guide 202 and the tubular member 196 blocks the lock member 188 so that lock member 188 remains retracted into the depression 190 and the extended portion 208 remains outside of the recess 194. Consequently, the lid hinge 154 remains uncoupled from the seat hinge 53 and the cylindrical member 48 so that the seat 132 can be moved to the closed position while the lid 146 remains open.

In the preferred embodiment of the device 30, the second hinge assembly can also include an anti-rotation device that prevents the lid 146 and the lid hinge 154 from being rotated to the open position. FIGS. 18–21 show one embodiment 214 of the anti-rotation device which includes first and second locking bosses 216 and 218 that are secured to and extend outwardly from the lid hinge 154 and the seat hinge 53, respectively. The anchor 152 further includes a base plate 220 to which the body portion 158 is secured. The first and second locking bosses 216 and 218 are aligned with the base plate 220 and extend over the base plate 220. The anti-rotation device 214 further includes a bridge member 222 and a locking bar 224 that is slidably engaged by the bridge member 222. The bridge member 222 is secured to and extends upwardly from the base plate 220. A thumb piece 226 is attached to the locking bar 224 and is used to slide the locking bar 224 between an unlocked configuration, shown in FIGS. 18–20, and a locked configuration, shown in FIG. 21. When the locking bar 224 is in the closed configuration, a first portion 228 of the locking bar 224 is subjacent the first locking boss 216 and a second portion 230 of the locking bar 224 is subjacent the second locking boss 218. The lid 146 and the seat 132 therefore cannot be moved to the open position because the portions 228 and 230 of the locking bar 224 block the movement of the bosses 216 and 218. When the locking bar 224 is moved to the unlocked configuration, shown in FIGS. 18-20, the portions 228 and 230 of the locking bar 224 are moved out of the rotational paths of the locking bosses 216 and 218 and the seat 132 and the lid 146 can be moved to the open position. The anti-rotation device 214 thus reversibly locks the lid 146 and the seat 132 in the closed position. In the preferred embodiment, the first portion 228 and the second portion 230 of the locking bar 224 are constructed as a single, continuous piece, as shown in FIGS. 18–21. Alternatively, the first and second portions 228 and 230 can be constructed as separate, spaced-apart members. Moreover, although the preferred embodiment includes the first and second portions 228 and 230, the anti-rotation device 214 can simply include the first portion 228 which blocks the movement of the lid hinge 154 via the locking boss 216 and thus effectively locks both the lid 146 and the seat 132 in the closed position.

Figure 23:
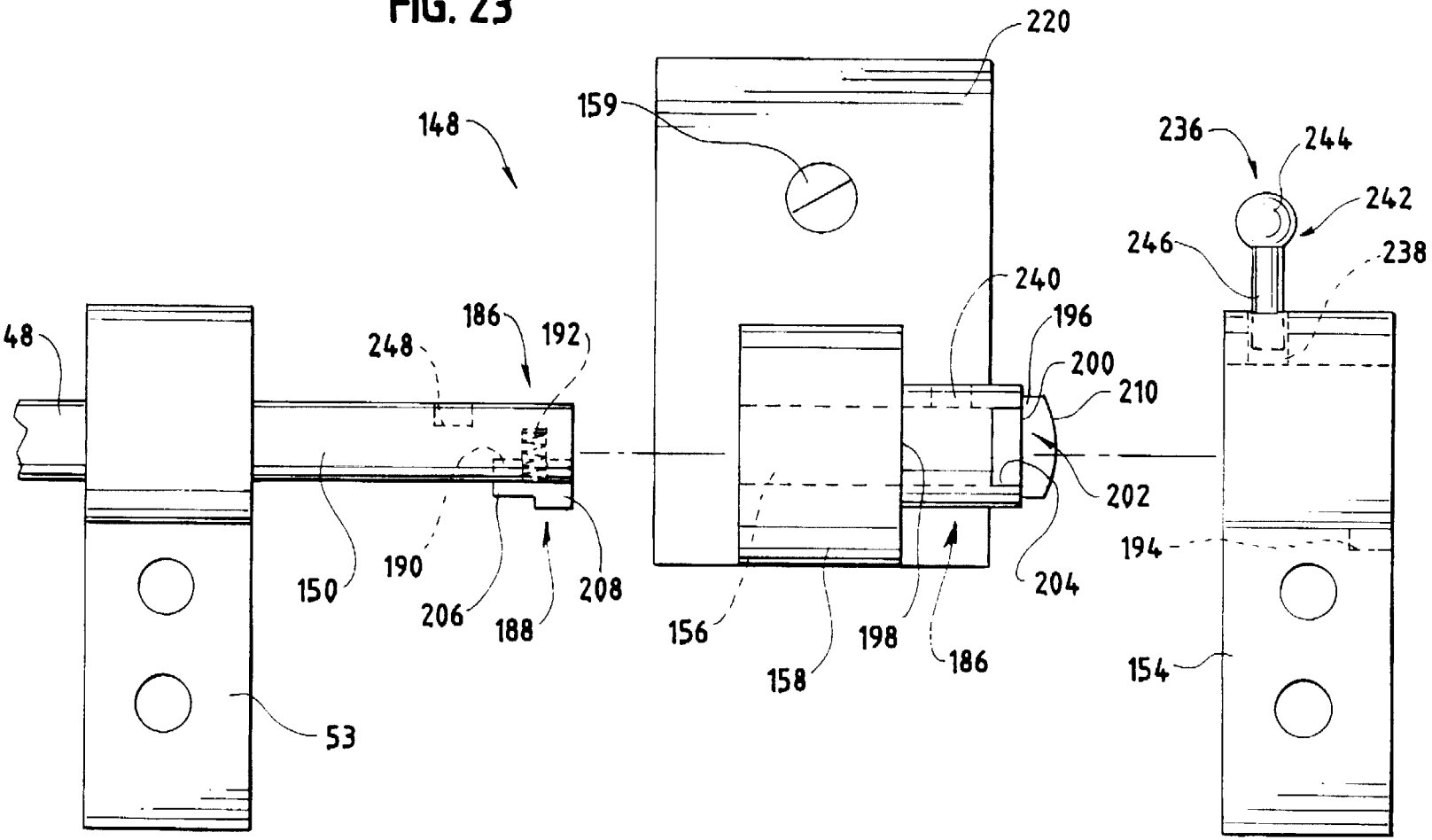
FIG. 23 is an exploded top plan view of the second hinge assembly, the seat hinge to lid hinge coupler, and the anti-rotation mechanism in FIG. 23.

FIGS. 22–24 show a second embodiment 236 of an anti-rotation device that prevents the lid 146 and the lid hinge 154 from being rotated to the open position. The anti-rotation device 236 includes a pair of holes 238 and 240 that are aligned with each other when the lid hinge 154 and the seat hinge 53 are in the closed configuration. The first hole 238 is formed in the lid hinge 154 and intersects the duct 162. The second hole 240 is formed in the tubular member 196. The anti-rotation device 236 further includes a catch member 242 that is moveable between a locked configuration and an unlocked configuration. In the preferred embodiment the catch member 242 includes an end piece 244 that is secured to a bolt portion 246. The bolt portion 246 is sized and shaped to fit within the first hole 238 and the second hole 240 and the end piece 244 provides a convenient way to grasp and move the catch member 242 between the locked and unlocked configurations. When the catch member 242 is in the unlocked configuration, shown in FIG. 23, the bolt portion 246 is positioned only within the first hole 238. Consequently, the catch member 242 does not impede the movement of the lid hinge 154 which therefore can be rotated to the open configuration. The catch member 242 is moved to the locked configuration, shown in FIG. 24, by sliding the catch member 242 towards the lid hinge 154 until the bolt portion 246 is partially positioned within the second hole 240 in the tubular member 196. In the locked configuration the lid hinge 154 cannot be moved toward the open position because the bolt portion 246 is partially positioned within the second hole 240 in the tubular member 196 and the tubular member 196 is secured to the anchor 152. The anti-rotation device 236 can be made even more secure by providing a third hole 248 in the pivot rod 150 and positioning the third hole 248 so that it is aligned with the first hole 238 and the second hole 240 when the lid hinge 154 and the seat hinge 53 are in the closed configuration. In this case, the bolt portion 246 is partially positioned within all three holes 238, 240, and 248 when the catch member 242 is in the locked configuration. It should also be noted that, because the lid hinge 154 is locked in the closed configuration, the seat 132 cannot be moved to the open position. The anti-rotation device 236 thus reversibly locks the seat 132 and the lid 146 in the closed position.

Various combinations of the coupling devices 164 and 186 and the anti-rotation devices 214 and 236 are possible, depending on the desired results. For example, the second hinge assembly 148 can include only a coupling device, such as the coupling device 164 or the coupling device 186, in which case the second hinge assembly couples the toilet lid 146 to the device 30 so that the lid 146 is automatically lowered when the toilet seat 132 is automatically lowered. Alternatively, the second hinge assembly can include only an anti-rotational device, such as the anti-rotation device 214 or the anti-rotation device 236. In this case, the second hinge assembly 148 permits the lid 146 and the toilet seat 132 to be locked in the closed position. In the preferred embodiment, however, the second hinge assembly 148 includes both a coupling device and an anti-rotational device. For example, the second hinge assembly 148 can include both the coupling device 164 and the anti-rotation device 214, as shown in FIG. 18. Alternatively, the second hinge assembly 148 can include both the coupling device 186 and the anti-rotation device 236 as shown in FIG. 22. The coupling device 186 can also be readily used in conjunction with the anti-rotation device 214.

Figure 31:
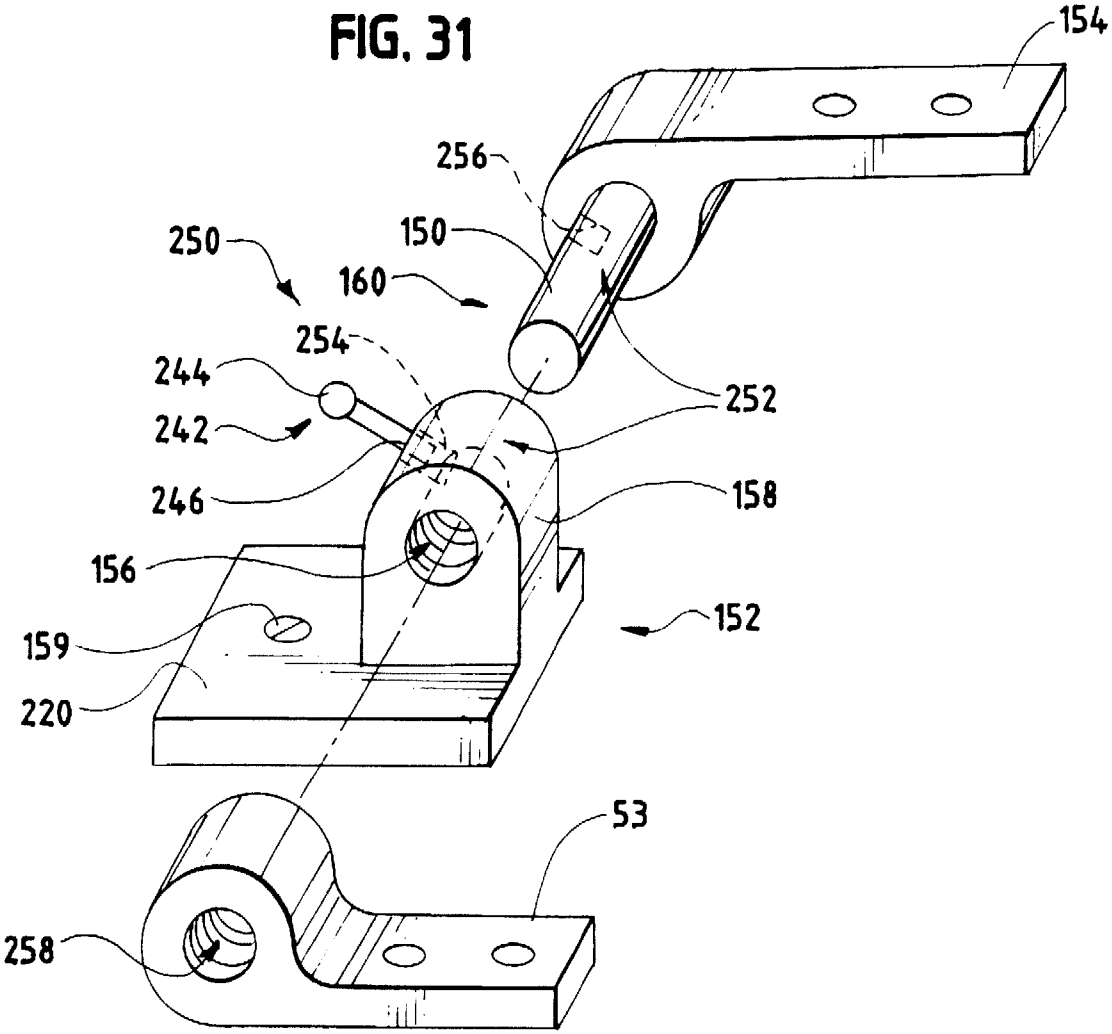
FIG. 31 is an exploded side perspective view alternative embodiment of a hinge assembly according to the invention and illustrates another alternative embodiment of an anti-rotation mechanism.
Figure 32:
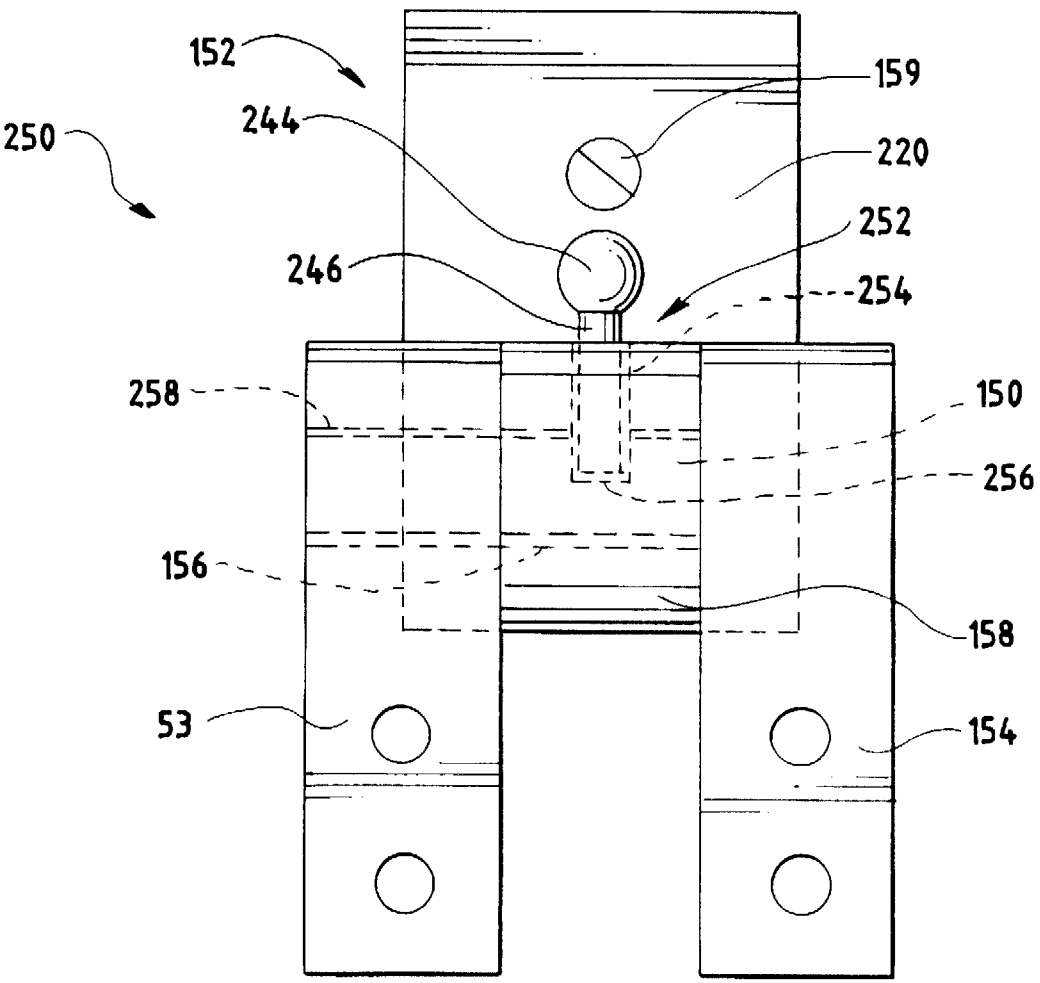
FIG. 32 is an assembled top plan view of the hinge assembly and the anti-rotation device in FIG. 31.

The second hinge assembly 148, together with any of the coupling devices 164 and 186 and the anti-rotation devices 214 and 236, can also be used as a stand-alone device that is not connected to an automatic closing device. In this case, the seat hinge 53 is not connected to the cylindrical member 48 of the first hinge assembly 44 and the seat 132 must be manually raised to the open position. However, the coupling devices 164 and 186 still function to couple the toilet lid 146 to the seat 132 so that the lid 146 is automatically lowered when the toilet seat 132 is lowered. Moreover, the anti-rotational devices 214 and 236 still function to lock the seat 132 and the lid 146 in the closed position. In addition, when the second hinge assembly 148 is used as a stand-alone device the relative positions of the seat hinge 53 and the lid hinge 154 can be exchanged so that the pivot rod 150 is secured to the lid hinge 154 and the seat hinge 53 rotatably engages the pivot rod 150. FIGS. 31 and 32 show an alternative embodiment 250 of a hinge assembly that can be used as a stand-alone device. Like the previous embodiment, the hinge assembly 250 includes the seat hinge 53, the pivot rod 150, the anchor 152, and the lid hinge 154. The hinge assembly 250 differs from the previous embodiment in that the pivot rod 150 is secured to the lid hinge 154 and a duct 258 is formed in the seat hinge 53 so that the seat hinge 53 rotatably engages the pivot rod 150. FIGS. 30 and 31 also show an alternative embodiment 252 of the anti-rotation device 236. Like the previous embodiment, the anti-rotation device 252 includes the catch member 242. However, in this embodiment a first hole 254 is formed in the body portion 158 of the anchor 152 and intersects the bore 156. In addition, a second hole 256 is formed in the pivot rod 150 and is positioned so that it is aligned with the first hole 254 when the lid hinge 154 is in the closed position. As with the previous embodiment, the catch member 242 is moveable between an unlocked configuration and a locked configuration. When the catch member 242 is in the unlocked configuration, shown in FIG. 31, the bolt portion 246 is positioned only within the first hole 254. Consequently, the catch member 242 does not impede the movement of the lid hinge 154 which therefore can be rotated to the open configuration. In the locked configuration, shown in FIG. 32, the bolt portion is positioned within both the first hole 254 and the second hole 256. Consequently, neither the lid hinge 154 nor the seat hinge 53 can be rotated to towards the open position.

When the second hinge assembly 148 is used as a stand-alone device, the hinge assembly 148 can also include any of the coupling devices 164 and 186 and the anti-rotational device 214. The coupling device 164 need only be modified so that the duct 162 is formed in the seat hinge and the latch guide 182 is also formed in the seat hinge 53 and intersects the duct 162. The coupling device 186 need only be modified so that the recess 194 is formed along the duct 162 in the seat hinge 53. The anti-rotation device can be readily used as previously described when the hinge assembly 148 is used as a stand-alone device. In a similar fashion, the hinge assembly 250 can also include any of the coupling devices 164 and 186 and the anti-rotational device 214.

In use, after the device 30 has been secured to the toilet bowl 140 and to the toilet seat 132 the device 30 operates in the previously described fashion. When the seat 132 is in the closed position, as shown in FIG. 16, the shaft 36 is in the de-activated position and the gear 42 is in the rest position, shown in FIGS. 8, 10A, and 10B. Raising the toilet seat 132 to the open position shown in FIG. 15 activates the timing member 32 and brings the shaft 36, the gear 42, and the cylindrical member 48 into the configuration shown in FIGS. 9, 11A, and 11B. If the seat 132 is left in the raised position, the seat 132 will automatically be lowered to the closed position at the completion of the pre-determined time interval, due to the interaction of the shaft 36, the gear 42, and the cylindrical member 48, as explained in reference to FIGS. 12A and 12B. However, because of the reversible connection between the gear 42 and the cylindrical member 48, the seat 132 can also be manually lowered to the closed position before the completion of the pre-determined time interval, as explained in reference to FIGS. 13A, 13B, and 14. Moreover, the second hinge assembly 148 couples the lid hinge 154 to the device 30 so that the movement of the lid hinge 154 can be readily controlled. Thus, for example, the lid hinge 154 and hence the lid 146 can be locked in the closed position by the anti-rotational means 214 or 236. Moreover, the coupling device 164 and the coupling device 186 couple the second hinge 154 to the seat hinge 53 so that both the seat 132 and the lid 146 move to the closed position at the end of the pre-determined time interval.

Although the device 30 has been described for closing the seat 132 of a conventional toilet 130, there are other uses for the device 30. For example, the device 30 can be used as an automatic closing device for animal feed bins. In this manner the amount of time an animal has access to the feed in the feed bin can be controlled by the self-closing action of the device 30. In addition, the device 30 can be used as an automatic closing device for refuge containers thereby minimizing the unsightliness of open refuse containers and minimizing access to the refuse by scavenging animals such as squirrels and rats. It also should be noted that various combinations of the components are possible, depending on the desired closing action. In the preferred embodiment, the shaft 36 is reversible coupled to the cylindrical member 48 of the hinge assemble so that the cover 132 does not move with the shaft 36 during the pre-determined time interval but instead is retained in the open position for at least a portion of the pre-determined time interval. In addition, in the preferred embodiment the cylindrical member 48 is reversibly connected to the gear 42 thereby facilitating manual closing of the cover 132 before the completion of the pre-determined time interval. Alternatively, the shaft 36 can be coupled to the cylindrical member 48, for example, by a non-retractable locking pin 58, so that the cylindrical member 48 and hence the cover 132 continuously rotate with the shaft 36 back to the de-activated position. In addition, the gear 42 can be connected to the cylindrical member 48, for example, by a non-retractable finger 92, so that manually lowering of the cover 132 also moves the shaft 36 to the de-activated position and deactivates the timing member 32.

Although the present invention has been described with reference to preferred embodiments, it will be understood that various changes and modifications will be suggested to one skilled in the art and it is intended that the invention encompass such changes and modifications as fall within the scope of the appended claims.

What is claimed is:

1. An automatic closing device for closing a container of the type having a cover which is hingedly mounted on a body and moveable between a closed position in which the cover is substantially flush with the body and an open position in which the cover is pivotally raised above the body, said automatic closing device for use in combination with a timing member of the type including timer means for measuring a predetermined time interval, a shaft rotatable between a de-activated position and an activated position, an arm moveable between an extended position and a retracted position, the shaft being operatively connected to the timer means so that rotation of the shaft to the activated position activates the timer means and so that the shaft automatically rotates to the de-activated position during the pre-determined time interval, and the arm being operatively connected to the timer means so that activation of the timer means by the shaft moves the arm to the retracted position and so that the arm moves to the extended position at the completion of the pre-determined time interval, said automatic closing device comprising:

a plate member having an opening formed therein, said plate member being secured to the timing member to align said opening with the shaft, the shaft extending from the timer means through said opening;

a first hinge assembly including a cylindrical member rotatable in a first direction and a second direction and having a chamber sized to receive a portion of the shaft therein, said portion of the shaft being positioned within said chamber;

a first hinge member secured to said cylindrical member opposite said portion of said shaft and rotating concurrently with said cylindrical member;

coupling means for coupling said hinge assembly to the timing member such that rotation of said cylindrical member in the first direction rotates the shaft from the de-activated position to the activated position;

a gear rotatable between a rest position and an energized position and having a centrally-positioned channel sized to encircle a portion of said cylindrical member, said gear being positioned to encircle said portion of said cylindrical member;

connection means for connecting said gear to said portion of said cylindrical member such that rotation of said cylindrical member in the first direction rotates said gear from the rest position to the energized position;

retention coupling means for coupling said gear to the arm when the arm is in the retracted position thereby retaining said gear in the energized position;

reverse rotation means for rotating said gear from the energized position to the rest position at the completion of the pre-determined time interval; and attaching means for attaching the cover of the container to said first hinge member such that moving the cover from the closed position to the open position rotates said cylindrical member in the first direction thereby rotating the shaft to the activated position and such that the cover moves to the closed position when said cylindrical member rotates in the second direction.

2. The automatic closing device of claim 1 wherein said retention means includes a notched rack secured to the arm and shaped to engage a portion of said gear.

3. The automatic closing device of claim 1 wherein said reverse rotation means includes a spring secured to said gear to bias said gear toward the rest position.

4. The automatic closing device of claim 1 further comprising a second hinge assembly including:

a pivot rod secured to said first hinge member, extending outwardly from said first hinge member opposite said cylindrical member, rotating in the first direction concurrent with said cylindrical member, and rotating in the second direction concurrent with said cylindrical member;

an anchor member having body portion and a bore extending through said body portion, said bore being sized and shaped to accommodate said pivot rod, said pivot rod extending from said first hinge member through said bore;

a second hinge member rotatably coupled to said pivot rod, rotatable between a closed configuration and an open configuration, and having a duct sized and shaped to receive a portion of said pivot rod, said portion of said pivot rod being positioned within said duct; and securement means for securing said anchor member to the body of the container.

5. The automatic closing device of claim 4 wherein said second hinge assembly further includes coupling means for coupling said second hinge member to said cylindrical member so that said second hinge member rotates towards the closed configuration when said cylindrical member rotates in the second direction.

6. The automatic closing device of claim 5 wherein said coupling means of said second hinge assembly includes:

an elongated track formed in said pivot rod and having a first end and a second end, said second end positioned at least partially along said portion of said pivot rod;

a latch slidably positioned within said elongated track and including a first portion and a second portion, said first portion having an outer surface shaped to conform with the shape of said pivot rod, said second portion attached to said first portion intermediate said first portion and said second end of said elongated track and extending outwardly from said elongated track;

biasing means for biasing said latch toward said first end of said track;

a latch guide formed in said second hinge member, positioned to intersect said duct, and shaped to accommodate said second portion of said latch; and a camming surface formed within said bore of said anchor member and positioned and shaped to engage said second portion of said latch, said camming surface urging said second portion into said latch guide when said cylindrical member rotates in the first direction thereby coupling said second hinge member to said cylindrical member, and said biasing means urging said latch towards said first end of said elongated track when said cylindrical member rotates in the second direction thereby uncoupling said second hinge member from said cylindrical member.

7. The automatic closing device of claim 5 wherein said coupling means of said second hinge assembly includes:

a recess formed along said duct;

a lock member retractable mounted within a depression formed along said portion of said pivot rod and having an extended portion and a camming surface, said extended portion being sized and shaped to fit within said recess and being positioned to engage said recess when the cover is in the open position and said second hinge member is in the open configuration; and retracting means for retracting said lock member into said depression as said pivot rod rotates in the second direction.

8. The automatic closing device of claim 7 wherein said retracting means includes:

a tubular member sized to receive said pivot rod and having a first end, a second end, and a cut-out guide formed along said first end, said cut-out guide defining an unlocking surface shaped to engage said camming surface of said lock member, said tubular member being secured to said body portion of said anchor member at said second end and positioned to encircle said pivot rod and to locate said lock member within said cut-out guide and said extended portion within said recess when the cover is in the open position and said second hinge member is in the open configuration, said second hinge member rotating towards the closed configuration when said pivot rod initially rotates in the second direction and said unlocking surface of cut-out guide engaging said camming surface of said lock member as said second hinge member rod rotates from the open configuration to the closed configuration thereby removing said extended portion of said lock member from said recess and allowing said pivot rod to rotate independently of said second hinge member.

9. The automatic closing device of claim 7 wherein said retracting means includes:

a tubular member sized to receive said pivot rod and having a first end, a second end, and a cut-out guide formed along said first end, said cut-out guide defining an unlocking surface shaped to engage said camming surface of said lock member, said tubular member being rotatably secured to said body portion of said anchor member at said second end, positioned to encircle said pivot rod, and rotatable between a first position and a second position, said tubular member being positioned to locate said lock member within said cut-out guide and said extended portion within said recess when the cover is in the open position, said second hinge member is in the open configuration, and said tubular member is in the first position whereby said second hinge member rotates towards the closed configuration when said pivot rod initially rotates in the second direction and said unlocking surface of cut-out guide engages said camming surface of said lock member as said second hinge member rod rotates from the open configuration to the closed configuration thereby removing said extended portion of said lock member from said recess and allowing said pivot rod to rotate independently of said second hinge member, and said tubular member being positioned to locate said lock member outside of said cut-out guide and said extended portion outside of said recess when the cover is in the open position, said second hinge member is in the open configuration, and said tubular member is in the second position whereby said pivot rod rotates in the second direction independently of said second hinge member.

10. The automatic closing device of claim 4 wherein said second hinge assembly further includes anti-rotation means for preventing the rotation of said second hinge member from the closed configuration to the open configuration.

11. The automatic closing device of claim 10 wherein said anti-rotation means includes:

a first hole formed in said second hinge member and intersecting said duct;

a tubular member sized to receive said pivot rod and having a first end and a second end, said tubular member being secured to said body portion of said anchor member at said second end and positioned to encircle said pivot rod, said pivot rod extending through said tubular member;

a second hole formed in said tubular member and positioned to align with said first hole when said second hinge member is in the closed configuration; and a catch member moveable between a locked configuration and an un-locked configuration and having a bolt portion sized and shaped to fit within said first and second holes, said bolt portion being positioned within both of said first and second holes when said catch member is in the locked configuration and being positioned within only said first hole when said catch member is in the un-locked configuration.

12. The automatic closing device of claim 10 wherein said anchor member further comprises a base plate secured to said body portion and extending outwardly from said body portion along one side thereof and wherein said anti-rotation means includes:

a first boss secured to said second hinge member, extending outwardly from said first hinge member, and aligned with said base plate;

a bridge member secured to said base plate and extending upwardly from said base plate; and a locking bar slidably engaged by said bridge member and moveable between a locked configuration and an unlocked configuration, a first portion of said locking bar being substantially subjacent said first boss when said locking bar is in the locked configuration.

13. The automatic closing device of claim 12 further comprising a second boss secured to said first hinge member, extending outwardly from said second hinge member, and aligned with said first boss, wherein a second portion of said locking bar is substantially subjacent said second boss when said locking bar is in the locked configuration.

14. The automatic closing device of claim 1 further comprising control means for controlling said rotation of said gear from the energized position to the rest position.

15. The automatic closing device of claim 14 wherein said control means includes:

a slot formed in said gear and positioned to trace an arcuate pathway when said gear is rotated;

a pinion rotatably mounted in said slot, said pinion moving in said arcuate path when said gear is rotated; and an arcuate notched guide positioned and shaped to engage said pinion as said pinion moves in said arcuate path.

16. The automatic closing device of claim 15 wherein said arcuate notched guide is formed on a surface of said plate.

17. The automatic closing device of claim 15 wherein said control means further includes a flange secured to said cylindrical member proximate said portion of said cylindrical member and positioned adjacent said gear and wherein said arcuate notched guide is formed on a surface of said flange.

18. The automatic closing device of claim 1 wherein said coupling means reversibly couples said hinge assembly to the timer member such that the shaft rotates independently of said hinge assembly when the shaft automatically rotates from the activated position to the de-activated position during the pre-determined time interval.

19. The automatic closing device of claim 18 wherein said reversible coupling means includes:

an aperture formed along the shaft proximate one end thereof;

a locking pin retractably mounted within a groove formed along said chamber of said cylindrical member and having a camming surface and an extended shank sized to fit within said aperture; and a sleeve sized to receive the shaft and having a first end, a second end, and a notch formed along said first end, said notch defining a first surface shaped to engage said shank of said locking pin and a second surface shaped to engage said camming surface of said locking pin, said sleeve being secured to said plate member at said second end and positioned to encircle the shaft and to locate said aperture proximate to said first surface of said notch when the shaft is in the de-activated position, said shank of said locking pin resting within said aperture of the shaft when the shaft is in the de-activated position and said second surface of said notch engaging said camming surface of said locking pin as the shaft rotates from the de-activated position to the activated position thereby removing said shank from said aperture and allowing the shaft to rotate independently of said hinge assembly.

20. The automatic closing device of claim 18 wherein said connection means reversibly connects said gear to said portion of said cylindrical member such that rotation of said gear from the energized position to the rest position rotates said cylindrical member in the second direction when said gear is connected to said cylindrical member, and such that said cylindrical member rotates in the second direction independent of said gear when said gear is disconnected from said cylindrical member.

21. The automatic closing device of claim 20 wherein said connection means includes;

a finger retractably mounted in a cavity formed along said channel of said gear, said finger being moveable between an extended position and a retracted position and having a locking surface and a camming surface; and a dimple formed along said portion of said cylindrical member and defining a first surface and a second surface, said first surface engaging said locking surface of said finger when said finger is in the extended position whereby rotation of said gear from the energized position to the rest position rotates said cylindrical member in the second direction, and said second surface engaging said camming surface when the cover is manually moved to the closed position thereby moving said finger to the retracted position, said cylindrical member rotating in said second direction independently in of said gear when said finger is in the retracted position.

22. The automatic closing device of claim 18 wherein said connection means includes;

an outwardly projecting finger positioned along said channel of said gear; and a dimple formed along said portion of said cylindrical member and positioned to engage said finger when the gear is in said rest position and when said gear is in the energized position, whereby the cover is moved to the closed position when said reverse rotation means rotates said gear from the energized position to the rest position.

23. The automatic closing device of claim 1 wherein said coupling means includes:

an aperture formed along the shaft proximate one end thereof; and a outwardly extending pin mounted along chamber of said cylindrical member, said pin being shaped and sized to engage said aperture and positioned along said chamber to engage said aperture, said cylindrical member being rotated in the second direction as the shaft rotates automatically rotates from the activated position to the de-activated position during the pre-determined time interval.

24. The automatic closing device of claim 1 wherein said connection means includes;

an outwardly projecting finger positioned along said channel of said gear; and a dimple formed along said portion of said cylindrical member and positioned to engage said finger when the gear is in said rest position and when said gear is in the energized position, whereby the cover is moved to the closed position when said reverse rotation means rotates said gear from the energized position to the rest position.

25. The automatic closing device of claim 1 wherein said connection means reversibly connects said gear to said portion of said cylindrical member such that rotation of said gear from the energized position to the rest position rotates said cylindrical member in the second direction when said gear is connected to said cylindrical member, and such that said cylindrical member rotates in the second direction independent of said gear when said gear is disconnected from said cylindrical member.

26. The automatic closing device of claim 25 wherein said connection means includes;

a finger retractably mounted in a cavity formed along said channel of said gear, said finger being moveable between an extended position and a retracted position and having an locking surface and a camming surface; and a dimple formed along said portion of said cylindrical member and defining a first surface and a second surface, said first surface engaging said locking surface of said finger when said finger is in the extended position whereby rotation of said gear from the energized position to the rest position rotates said cylindrical member in the second direction, and said second surface engaging said camming surface when the cover is manually moved to the closed position thereby moving said finger to the retracted position, said cylindrical member rotating in said second direction independently in of said gear when said finger is in the retracted position.

27. The automatic closing device of claim 25 wherein said hinge assembly further includes a flange secured to said cylindrical member proximate said portion of said cylindrical member and positioned adjacent said gear and wherein said device further comprises:

a first slot formed in said gear and positioned to trace an arcuate pathway when said gear is rotated;

a pinion rotatably mounted in said slot, said pinion moving in said arcuate path when said gear is rotated;

a first arcuate notched guide formed on a surface of said plate member and positioned and shaped to engage said pinion as said pinion moves in said arcuate path;

a second slot formed on said surface of said plate member and positioned to engage said pinion when said gear is rotated to the energized position; and a second arcuate notched guide formed on a surface of said flange and positioned and shaped to engage said pinion as said pinion moves in said arcuate path;

said pinion being engaged by said first and second arcuate guides when said gear is connected to said cylindrical member and said pinion being engaged by said second slot and by said second arcuate notched guide when said gear is disconnected from said cylindrical member.

* * * * *